US010026415B2

(12) United States Patent
Janse et al.

(10) Patent No.: US 10,026,415 B2
(45) Date of Patent: Jul. 17, 2018

(54) NOISE SUPPRESSION

(71) Applicant: KONINKLIJKE PHILIPS N.V., Eindhoven (NL)

(72) Inventors: Cornelis Pieternella Janse, Eindhoven (NL); Leonardus Cornelis Antonius Van Stuivenberg, Helmond (NL); Patrick Kechichian, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 117 days.

(21) Appl. No.: 15/120,130

(22) PCT Filed: Mar. 2, 2015

(86) PCT No.: PCT/EP2015/054228

§ 371 (c)(1),
(2) Date: Aug. 19, 2016

(87) PCT Pub. No.: WO2015/139938

PCT Pub. Date: Sep. 24, 2015

(65) Prior Publication Data

US 2018/0122399 A1 May 3, 2018

(30) Foreign Application Priority Data

Mar. 17, 2014 (EP) ..... 14160242

(51) Int. Cl.
*H04R 3/00* (2006.01)
*G10L 21/0232* (2013.01)
(Continued)

(52) U.S. Cl.
CPC ..... *G10L 21/0232* (2013.01); *G10L 21/04* (2013.01); *G10L 25/18* (2013.01);
(Continued)

(58) Field of Classification Search
None
See application file for complete search history.

(56) References Cited

U.S. PATENT DOCUMENTS 7,146,012 B1 12/2006 Belt et al.
7,587,056 B2 9/2009 Zhang
(Continued)

OTHER PUBLICATIONS

Martin et al, "A noise reduction preprocessor for mobile voice communication." pp. 1-13. 2004.*
(Continued)

*Primary Examiner* — Curtis Kuntz
*Assistant Examiner* — Qin Zhu

(57) ABSTRACT

A noise suppressor comprises a first (401) and a second transformer (403) for generating a first and second frequency domain signal from a frequency transform of a first and second microphone signal. A gain unit (405, 407, 409) determines time frequency tile gains in response to a difference measure for magnitude time frequency tile values of the first frequency domain signal and magnitude time frequency tile values of the second frequency domain signal. A scaler (411) generates a third frequency domain signal by scaling time frequency tile values of the first frequency domain signal by the time frequency tile gains; and the resulting signal is converted to the time domain by a third transformer (413). A designator (405, 407, 415) designates time frequency tiles of the first frequency domain signal as speech tiles or noise tiles; and the gain unit (409) determines the gains in response to the designation of the time frequency tiles as speech tiles or noise tiles.

15 Claims, 11 Drawing Sheets

(51) Int. Cl.
*G10L 21/04* (2013.01)
*G10L 21/0216* (2013.01)
*G10L 25/18* (2013.01)

(52) U.S. Cl.
CPC .... *H04R 3/005* (2013.01); *G10L 2021/02165* (2013.01); *G10L 2021/02166* (2013.01)

(56) References Cited

U.S. PATENT DOCUMENTS

| | | | | |
|---|---|---|---|---|
| 7,602,926 | B2 | 10/2009 | Roovers | |
| 8,239,194 | B1 | 8/2012 | Paniconi | |
| 2011/0013792 | A1* | 1/2011 | Iwano | H04R 25/356 381/317 |
| 2012/0322511 | A1 | 12/2012 | Fox | |
| 2013/0054232 | A1 | 2/2013 | Unno | |
| 2014/0126745 | A1* | 5/2014 | Dickins | H04R 3/002 381/94.3 |
| 2017/0125033 | A1* | 5/2017 | Kjems | G10L 21/0232 |

OTHER PUBLICATIONS

Boll, "Suppression of Acoustic Noise in Speech Using Spectral Subtraction", IEEE Transactions on Acoustics, Speech, and Signal Processing, vol. ASSP-27, No. 2, Apr. 1979, p. 113-120.

R. Martin, "Spectral Subtraction Based on Minimum Statisitics", Signal Processing VII, Proc. EUSIPCO, Edinburgh (Scotland UK), Sep. 1994, pp. 1182-1185.

* cited by examiner

NOISE SUPPRESSION

CROSS-REFERENCE TO PRIOR APPLICATIONS

This application is the U.S. National Phase application under 35 U.S.C. § 371 of International Application No. PCT/EP2015/054228, filed on Mar. 2, 2015, which claims the benefit European Patent Application No. EP14160242.5, filed on Mar. 17, 2014. These applications are hereby incorporated by reference herein.

FIELD OF THE INVENTION

The invention relates to noise suppression and in particular, but not exclusively, to suppression of non-stationary diffuse noise based on signals captured from two microphones.

BACKGROUND OF THE INVENTION

Capturing audio, and in particularly speech, has become increasingly important in the last decades. Indeed, capturing speech has become increasingly important for a variety of applications including telecommunication, teleconferencing, gaming etc. However, a problem in many scenarios and applications is that the desired speech source is typically not the only audio source in the environment. Rather, in typical audio environments there are many other audio/noise sources which are being captured by the microphone. One of the critical problems facing many speech capturing applications is that of how to best extract speech in a noisy environment. In order to address this problem a number of different approaches for noise suppression have been proposed.

One of the most difficult tasks in speech enhancement is the suppression of non-stationary diffuse noise. Diffuse noise is for example an acoustic (noise) sound field in a room where the noise is coming from all directions. A typical example is so-called "babble"-noise in e.g. a cafeteria or restaurant in which there are many noise sources distributed across the room.

When recording a desired speaker in a room with a microphone or microphone array, the desired speech is captured in addition to background noise. Speech enhancement can be used to try to modify the microphone signal such that the background noise is reduced while the desired speech is as unaffected as possible. When the noise is diffuse, one proposed approach is to try to estimate the spectral amplitude of the background noise and to modify the spectral amplitude such that the spectral amplitude of the resulting enhanced signal resembles the spectral amplitude of the desired speech signal as much as possible. The phase of the captured signal is not changed in this approach.

FIG. 1 illustrates an example of a noise suppression system in accordance with prior art. In the example, input signals are received from two microphones with one being considered to be a reference microphone and the other being a main microphone capturing the desired audio source, and specifically capturing speech. Thus, a reference microphone signal x(n) and a primary microphone signal are received. The signals are converted to the frequency domain in transformers 101, 103, and the magnitude in individual time frequency tiles are generated by magnitude units 105, 107. The resulting magnitude values are fed to a unit 109 for calculating gains. The frequency domain values of the primary signal are multiplied by the resulting gains in a multiplier 111 thereby generating a frequency spectrum compensated output signal which is converted to the time domain in another transform unit 113.

The approach can best be considered in the frequency domain. Frequency domain signals are first generated by computing a short-time Fourier transform (STFT) of e.g. overlapping Hanning windowed blocks of the time domain signal. The STFT is in general a function of both time and frequency, and is expressed by the two arguments $t_k$ and $\omega_l$ with $t_k$=kB being the discrete time, and where k is the frame index, B the frame shift, and $\omega_l$=l $\omega_0$ is the (discrete) frequency, with l being the frequency index and $\omega_0$ denoting the elementary frequency spacing.

Let $Z(t_k,\omega_l)$ be the (complex) microphone signal which is to be enhanced. It consists of the desired speech signal $Z_s(t_k,\omega_l)$ and the noise signal $Z_n(t_k,\omega_l)$:

$$Z(t_k,\omega_l)=Z_s(t_k,\omega_l)+Z_n(t_k,\omega_l).$$

The microphone signal is fed to a post-processor which performs noise suppression by modifying the spectral amplitude of the input signal while leaving the phase unchanged. The operation of the post-processor can be described by a gain function, which in the case of spectral amplitude subtraction typically has the form:

$$G(t_k, \omega_l) = \frac{|Z(t_k, \omega_l)| - |Z_n(t_k, \omega_l)|}{|Z(t_k, \omega_l)|},$$

where |.| is the modulus operation.

The output signal is then calculated as:

$$Q(t_k,\omega_l)=Z(t_k,\omega_l)*G(t_k,\omega_l).$$

After being transformed back to the time domain, the time domain signal is reconstructed by combining the current and the previous frame taking into account that the original time signal was windowed and time overlapped (i.e. an overlap-and-add procedure is performed).

The gain function can be generalized to:

$$G(t_k, \omega_l) = \left(\frac{|Z(t_k, \omega_l)|^\alpha - |Z_n(t_k, \omega_l)|^\alpha}{|Z(t_k, \omega_l)|^\alpha}\right)^{1/\alpha}.$$

For=1, this describes a gain function for spectral amplitude subtraction, for $\alpha$=2 this describes a gain function for spectral power which is also often used. The following description will focus on spectral amplitude subtraction, but it will be appreciated that the provided reasoning can also be applied to, in particular, spectral power subtraction.

The amplitude spectrum of the noise in $|Z_n(t_k,\omega_l)|$ is in general not known. Therefore, an estimate $|Z_n(\widehat{t_k,\omega}_l)|$ has to be used instead. Since that estimate is not always accurate, an oversubtraction factor $\gamma_n$ for the noise is used (i.e. the noise is scaled with a factor of more than one). However, this may also lead to a negative value for $|Z(t_k,\omega_l)|-\gamma_n|Z_n(\widehat{t_k,\omega}_l)|$, which is undesired. For that reason, the gain function is limited to zero or to a certain small positive value.

For the gain function, this results in:

$$G(t_k, \omega_l) = \mathrm{MAX}\left(\frac{|Z(t_k, \omega_l)| - \gamma_n|Z_n(\widehat{t_k,\omega}_l)|}{|Z(t_k, \omega_l)|^\alpha}, \theta\right)$$

$$0 \le \theta.$$

For stationary noise, $|Z_n(t_k,\omega_l)|$ can be estimated by measuring and averaging the amplitude spectrum $|Z(t_k,\omega_l)|$ during silence.

However, for non-stationary noise, an estimate of $|Z_n(t_k,\omega_l)|$ cannot be derived from such an approach since the characteristics will change with time. This tends to prevent an accurate estimate to be generated from a single microphone signal. Instead, it has been proposed to use an extra microphone to be able to estimate $|Z_n(t_k,\omega_l)|$ As a specific example, a scenario can be considered where there are two microphones in a room with one microphone being positioned close to the desired speaker (the primary microphone) and the other microphone being further away from the speaker (the reference microphone). In this scenario, it can often be assumed that the primary microphone contains the desired speech component as well as a noise component, whereas the reference microphone signal can be assumed to not contain any speech but only a noise signal recorded at the position of the reference microphone. The microphone signals can be denoted by:

$$Z(t_k,\omega_l)=Z_s(t_k,\omega_l)+Z_n(t_k,\omega_l)$$

and $$X(t_k,\omega_l)=X_n(t_k,\omega_l)$$

for the primary microphone and reference microphone respectively.

To relate the noise components in the microphone signals we define a so-called coherence term as:

$$C(t_k,\omega_l)=\frac{E\{|Z_n(t_k,\omega_l)|\}}{E\{|X_n(t_k,\omega_l)|\}},$$

where $E\{.\}$ is the expectation operator. The coherence term is an indication of the average correlation between the amplitudes of the noise component in the primary microphone signal and the amplitudes of the reference microphone signal.

Since $C(t_k,\omega_l)$ is not dependent on the instantaneous audio at the microphones but instead depends on the spatial characteristics of the noise sound field, the variation of $C(t_k,\omega_l)$ as a function of time is much less than the time variations of $Z_n$ and $X_n$.

As a result $C(t_k,\omega_l)$ can be estimated relatively accurately by averaging $|Z_n(t_k,\omega_l)|$ and $|X_n(t_k,\omega_l)|$ over time during the periods where no speech is present in z. An approach for doing so is disclosed in U.S. Pat. No. 7,602,926, which specifically describes a method where no explicit speech detection is needed for determining $C(t_k,\omega_l)$.

Similarly to the case for stationary noise, an equation for the gain function for two microphones can then be derived as:

$$G(t_k,\omega_l)=\mathrm{MAX}\left(\frac{|Z(t_k,\omega_l)|-\gamma_n C(t_k,\omega_l)|X(t_k,\omega_l)|}{|Z(t_k,\omega_l)|},\theta\right)$$

$$0\le\theta.$$

Since X does not contain speech, the magnitude of X multiplied by the coherence term $C(t_k,\omega_l)$ can be considered to provide an estimate of the noise component in the primary microphone signal. Consequently, the provided equation may be used to shape the spectrum of the first microphone signal to correspond to the (estimated) speech component by scaling the frequency domain signal, i.e. by:

$$Q(t_k,\omega_l)=Z(t_k,\omega_l)*G(t_k,\omega_l).$$

However, although the described approach may provide advantageous performance in many scenarios, it may in some scenarios provide less than optimum performance. In particular, in some scenarios, the noise suppression may be less than optimum. In particular, for diffuse noise the improvement in the Signal-to-Noise-Ratio (SNR) may be limited, and often the so-called SNR Improvement (SNRI) is in practice found to be limited to around 6-9 dB. Although, this may be acceptable in some applications, it will in many scenarios tend to result in a significant remaining noise component degrading the perceived speech quality. Furthermore, although other noise suppression techniques can be used, these tend to also be suboptimal and e.g. tend to be complex, inflexible, impractical, computationally demanding, require complex hardware (e.g. a high number of microphones), and/or provide suboptimal noise suppression.

Hence, an improved noise suppression would be advantageous, and in particular a noise suppression allowing reduced complexity, increased flexibility, facilitated implementation, reduced cost (e.g. not requiring a large number of microphones), improved noise suppression and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a noise suppressor for suppressing noise in a first microphone signal, the noise suppressor comprising: a first transformer for generating a first frequency domain signal from a frequency transform of a first microphone signal, the first frequency domain signal being represented by time frequency tile values; a second transformer for generating a second frequency domain signal from a frequency transform of a second microphone signal, the second frequency domain signal being represented by time frequency tile values; a gain unit for determining time frequency tile gains as a non-negative monotonic function of a difference measure being indicative of a difference between a first monotonic function of a magnitude time frequency tile value of the first frequency domain signal and a second monotonic function of a magnitude time frequency tile value of the second frequency domain signal; and a scaler for generating an output frequency domain signal by scaling time frequency tile values of the first frequency domain signal by the time frequency tile gains; the noise suppressor further comprising: a designator for designating time frequency tiles of the first frequency domain signal as speech tiles or noise tiles; and wherein the gain unit is arranged to determine the time frequency tile gains in response to the designation of the time frequency tiles of the first frequency domain signal as speech tiles or noise tiles such that a lower gain value for a time frequency tile gain of a time frequency tile is determined when the time frequency tile is designated as a noise tile than when the time frequency tile is designated as a speech tile.

The invention may provide improved and/or facilitated noise suppression in many embodiments. In particular, the invention may allow improved suppression of non-stationary and/or diffuse noise. An increased signal or speech to noise ratio can often be achieved, and in particular, the approach may in practice increase the upper bound on the potential SNR improvement. Indeed, in many practical scenarios, the invention may allow an improvement in SNR of the noise suppressed signal from around 6-8 dB to in excess of 20 dB.

The approach may typically provide improved noise suppression, and may in particular allow improved suppression of noise without a corresponding suppression of speech. An improved signal to noise ratio of the suppressed signal may often be achieved.

The gain unit is arranged to determine different time frequency tile gains separately for at least two time frequency tiles. In many embodiments, the time frequency tiles may be divided into a plurality of sets of time frequency tiles, and the gain unit may be arranged to independently and/or separately determine gains for each of the sets of time frequency tiles. In many embodiments, the gain for time frequency tiles of one set of time frequency tiles may depend on properties of the first frequency domain signal and the second frequency domain signal only in the time frequency tiles belonging to the set of time frequency tiles.

The gain unit may determine different gains for a time frequency tile if this is designated as a speech tile than if it is designated as a noise tile. The gain unit may specifically be arranged to calculate the gain for a time frequency tile by evaluating a function, the function being dependent on the designation of the time frequency tile. In some embodiments, the gain unit may be arranged to calculate the gain for a time frequency tile by evaluating a different function when the time frequency tile is designated as a speech tile than if it is designated as a noise tile. A function, equation, algorithm, and/or parameter used in determining a time frequency tile gain may be different when the time frequency tile is designated as a speech tile than if it is designated as a noise tile.

A time frequency tile may specifically correspond to one bin of the frequency transform in one time segment/frame. Specifically, the first and second transformers may use block processing to transform consecutive segments of the first and second signal. A time frequency tile may correspond to a set of transform bins (typically one) in one segment/frame.

The designation as speech or noise (time frequency) tiles may in some embodiments be performed individually for each time frequency tile. However, often a designation may apply to a group of time frequency tiles. Specifically, a designation may apply to all time frequency tiles in one time segment. Thus, in some embodiments, the first microphone signal may be segmented into transform time segments/frames which are individually transformed to the frequency domain, and a designation of the time frequency tiles as speech or noise tiles may be common for all time frequency tiles of one segment/frame.

In some embodiments, the noise suppressor may further comprise a third transformer for generating an output signal from a frequency to time transform of the output frequency domain signal. In other embodiments, the output frequency domain signal may be used directly. For example, speech recognition or enhancement may be performed in the frequency domain and may accordingly directly use the output frequency domain signal without requiring any conversion to the time domain.

In accordance with an optional feature of the invention, the gain unit is arranged to determine a gain value for a time frequency tile gain of a time frequency tile as a function of the difference measure for the time frequency tile.

This may provide an efficient noise suppression and/or facilitated implementation. In particular, it may in many embodiments result in efficient noise suppression which adapts efficiently to the signal characteristics, yet may be implemented without requiring high computational loads or extremely complex processing.

The function may specifically be a monotonic function of the difference measure, and the gain value may specifically be proportional to the difference value.

In accordance with an optional feature of the invention, at least one of the first monotonic function and the second monotonic function is dependent on whether the time frequency tile is designated as a speech tile or as a noise tile.

This may provide an efficient noise suppression and/or facilitated implementation. In particular, it may in many embodiments result in efficient noise suppression which adapts efficiently to the signal characteristics, yet may be implemented without requiring high computational loads or extremely complex processing.

The at least one of the first monotonic function and the second monotonic function provides a different output value for the same magnitude time frequency tile value of the first, respectively second, frequency domain signal, for the time frequency tile when the time frequency tile is designated as a speech tile than when it is designated a noise tile.

In accordance with an optional feature of the invention, the second monotonic function comprises a scaling of the magnitude time frequency tile value of the second frequency domain signal for the time frequency tile with a scale value dependent on whether the time frequency tile is designated as a speech time frequency tile or a noise time frequency tile.

This may provide an efficient noise suppression and/or facilitated implementation. In particular, it may in many embodiments result in efficient noise suppression which adapts efficiently to the signal characteristics, yet may be implemented without requiring high computational loads or extremely complex processing.

In accordance with an optional feature of the invention, the gain unit is arranged to generate a noise coherence estimate indicative of a correlation between an amplitude of the second microphone signal and an amplitude of a noise component of the first microphone signal and at least one of the first monotonic function and the second monotonic function is dependent on the noise coherence estimate.

This may provide an efficient noise suppression and/or facilitated implementation. The noise coherence estimate may specifically be an estimate of the correlation between the amplitudes of the first microphone signal and the amplitudes of the second microphone signal when there is no speech, i.e. when the speech source is inactive. The noise coherence estimate may in some embodiments be determined based on the first and second microphone signals, and/or the first and second frequency domain signals. In some embodiments, the noise correlation estimate may be generated based on a separate calibration or measurement process.

In accordance with an optional feature of the invention, the first monotonic function and the second monotonic function are such that an expected value of the difference measure is negative if an amplitude relationship between the first microphone signal and the second microphone signal corresponds to the noise coherence estimate and the time frequency tile is designated as a noise tile.

In accordance with an optional feature of the invention, the gain unit is arranged to vary at least one of the first monotonic function and the second monotonic function such that the expected value of the difference measure for the amplitude relationship between the first microphone signal and the second microphone signal corresponding to the noise coherence estimate is different for a time frequency tile designated as a noise tile than for a time frequency tile designated as a speech tile.

In accordance with an optional feature of the invention, a gain difference for a time frequency tile being designated as a speech tile and a noise tile is dependent on at least one value from the group consisting of: a signal level of the first microphone signal; a signal level of the second microphone signal; and a signal to noise estimate for the first microphone signal.

This may provide an efficient noise suppression and/or facilitated implementation. In particular, it may in many embodiments result in efficient noise suppression which adapts efficiently to the signal characteristics yet may be implemented without requiring high computational loads or extremely complex processing.

In accordance with an optional feature of the invention, the difference measure for a time frequency tile is dependent on whether the time frequency tile is designated as a noise tile or a speech tile.

This may provide an efficient noise suppression and/or facilitated implementation.

In accordance with an optional feature of the invention, the designator is arranged to designate time frequency tiles of the first frequency domain signal as speech tiles or noise tiles in response to difference values generated in response to the difference measure for a noise tile to the magnitude time frequency tile values of the first frequency domain signal and magnitude time frequency tile values of the second frequency domain signal.

This may allow for a particularly advantageous designation. In particular, a reliable designation may be achieved while at the same time allowing reduced complexity. It may specifically allow corresponding, or typically the same, functionality to be used for both the designation of tiles as for the gain determination.

In many embodiments, the designator is arranged to designate a time frequency tile as a noise tile if the difference value is below a threshold.

In accordance with an optional feature of the invention, the designator is arranged to filter difference values over a plurality of time frequency tiles, the filtering including time frequency tiles differing in both time and frequency.

This may in many scenarios and applications provide an improved designation of time frequency tiles resulting in improved noise suppression.

In accordance with an optional feature of the invention, the gain unit is arranged to filter gain values over a plurality of time frequency tiles, the filtering including time frequency tiles differing in both time and frequency.

This may provide substantially improved performance, and may typically allow substantially improved signal to noise ratio. The approach may improve noise suppression by applying a filtering to a gain value for a time frequency tile where the filtering is both a frequency and time filtering.

In accordance with an optional feature of the invention, the gain unit is arranged to filter at least one of the magnitude time frequency tile values of the first frequency domain signal and the magnitude time frequency tile values of the second frequency domain signal; the filtering including time frequency tiles differing in both time and frequency.

This may provide substantially improved performance, and may typically allow substantially improved signal to noise ratio. The approach may improve noise suppression by applying a filtering to a signal value for a time frequency tile where the filtering is both a frequency and time filtering.

In many embodiments, the gain unit is arranged to filter both the magnitude time frequency tile values of the first frequency domain signal and the magnitude time frequency tile values of the second frequency domain signal; where the filtering includes time frequency tiles differing in both time and frequency.

In accordance with an optional feature of the invention, the noise suppressor further comprises an audio beamformer arranged to generate the first microphone signal and the second microphone signal from signals from a microphone array.

This may improve performance and may allow improved signal to noise ratios of the suppressed signal. In particular, the approach may allow a reference signal with reduced contribution from the desired source to be processed by the algorithm to provide improved designation and/or noise suppression.

In accordance with an optional feature of the invention, the noise suppressor further comprises an adaptive canceller for cancelling a signal component of the first microphone signal correlated with the second microphone signal from the first microphone signal.

This may improve performance and may allow improved signal to noise ratios of the suppressed signal. In particular, the approach may allow a reference signal with reduced contribution from the desired source to be processed by the algorithm to provide improved designation and/or noise suppression.

In accordance with an optional feature of the invention, the difference measure is determined as a difference between a first value given as a monotonic function of a magnitude time frequency tile value of the first frequency domain signal and a second value given as a monotonic function of a magnitude time frequency tile value of the second frequency domain signal.

According to an aspect of the invention there is provided a method of suppressing noise in a first microphone signal, the method comprising: generating a first frequency domain signal from a frequency transform of a first microphone signal, the first frequency domain signal being represented by time frequency tile values; generating a second frequency domain signal from a frequency transform of a second microphone signal, the second frequency domain signal being represented by time frequency tile values; determining time frequency tile gains in response to a difference measure for magnitude time frequency tile values of the first frequency domain signal and magnitude time frequency tile values of the second frequency domain signal; and generating an output frequency domain signal by scaling time frequency tile values of the first frequency domain signal by the time frequency tile gains; the method further comprising: designating time frequency tiles of the first frequency domain signal as speech tiles or noise tiles; and wherein the time frequency tile gains are determined in response to the designation of the time frequency tiles of the first frequency domain signal as speech tiles or noise tiles.

In some embodiments, the method may further comprise the step of generating an output signal from a frequency to time transform of the output frequency domain signal.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

Figure 1:
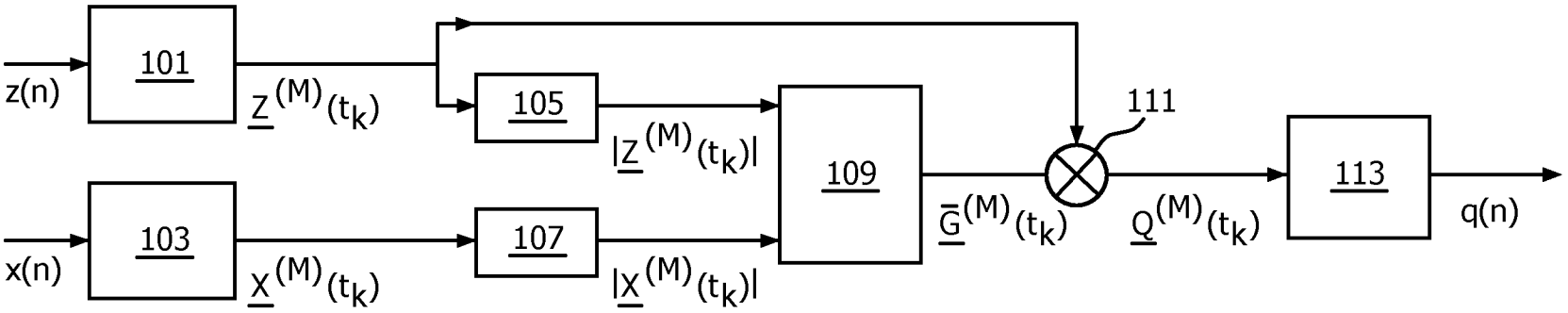
FIG. 1 is an illustration of an example of a noise suppressor in accordance with prior art.

The inventors of the current application have realized that the performance of the prior art approach of FIG. 1 tends to provide suboptimal performance for non-stationary/diffuse noise, and have furthermore realized that improvements are possible by introducing specific concepts that can mitigate or eliminated restrictions on performance experienced by the system of FIG. 1 for non-stationary/diffuse noise.

Specifically, the inventors have realized that the approach of FIG. 1 for diffuse noise has a limited Signal-to-Noise-Ratio Improvement (SNRI) range. Specifically, the inventors have realized that when increasing the oversubtraction factor $\gamma_n$ in the conventional functions as previously set out, other disadvantageous effects may be introduced, and specifically that an increase in speech attenuation during speech may result.

This can be understood by looking at the characteristics of an ideal spherically isotropic diffuse noise field. When two microphones are placed in such a field at distance d apart and providing microphone signals $X_1(t_k,\omega_l)$ and $X_2(t_k,\omega_l)$ respectively, we have:

$$E\{|X_1(t_k,\omega)|^2\} = E\{|X_2(t_k,\omega)|^2\} = 2\sigma^2 \text{ and}$$

$$E\{X_1(t_k,\omega).X_2^*(t_k,\omega)\} = 2\sigma^2\frac{\sin(kd)}{kd} = 2\sigma^2\text{sinc}(kd),$$

with the wave number $k=\omega/c$ is the velocity of sound) and $\sigma^2$ the variance of the real and imaginary parts of $X_1(t_k,\omega_l)$ and $X_2(t_k,\omega_l)$, which are Gaussian distributed.

The coherence function between $X_1(t_k,\omega_l)$ and $X_2(t_k,\omega_l)$ is given by:

$$\gamma(t_k,\omega) = \frac{E\{X_1(t_k,\omega).X_2^*(t_k,\omega)\}}{\sqrt{E\{|X_1(t_k,\omega)|^2\}.E\{|X_2(t_k,\omega)|^2\}}} = \text{sinc}(kd).$$

From the coherence function, it follows that $X_1(t_k,\omega_l)$ and $X_2(t_k,\omega_l)$ are uncorrelated for higher frequencies and large distances. If, for example, the distance is larger than 3 meters, then for frequencies above 200 Hz $X_1(t_k,\omega_l)$ and $X_2(t_k,\omega_l)$ are substantially uncorrelated.

Using these characteristics we have $C(t_k,\omega_l)=1$ and the gain function reduces to:

$$G(t_k,\omega_l) = \text{MAX}\left(\frac{|Z(t_k,\omega_l)| - \gamma_n|X(t_k,\omega_l)|}{|Z(t_k,\omega_l)|}, \theta\right)$$

$$0 \le \theta.$$

If we assume no speech is present. i.e. $Z(t_k,\omega_l)=Z_n(t_k,\omega_l)$, and look at the numerator then $|Z(t_k,\omega_l)|$ and $|X(t_k,\omega_l)|$ will be Rayleigh distributed, since the real and imaginary parts are Gaussian distributed and independent. Suppose $\gamma_n=1$ and $\theta=0$. Consider the variable $$d=|Z(t_k,\omega_l)|-|X(t_k,\omega_l)$$

The mean of the difference of two stochastic variables equals the difference of the means:

$$E\{d\}=0.$$

The variance of the difference of two stochastic signals equals the sum of the individual variances:

$$\text{var}(d)=(4-\pi)\sigma^2.$$

If we bound d to zero (i.e. negative values are set to zero), then, since the distribution of d is symmetrical around zero, the power of d is half the value of the variance of d:

$$E\{d^2\} = \frac{4-\pi}{2}\sigma^2.$$

If we now compare the power of the residual signal with the power of the input signal ($2\sigma^2$), we get for the suppression due to the postprocessor:

$$A = -10\log_{10}\left(1-\frac{\pi}{4}\right) = 6.68\text{ dB}.$$

Thus, the attenuation is limited to a relatively low value of less than 7 dB for the case where only background noise is present.

If we want to increase the noise suppression by increasing $\gamma_n$ and we consider the bounded variable:

$$db=\text{MAX}((|Z(t_k,\omega_l)|-\gamma_n|X(t_k,\omega_l)|),0),$$

then we can derive for the attenuation of the postprocessor:

$$A = -10\log_{10}\left\{\frac{\gamma_n}{2}\left(-\pi+\frac{2}{\gamma_n}+2\arctan(\gamma_n)\right)\right\}.$$

The attenuation is as a function of the oversubtraction factor $\gamma_n$ for some exemplary values may thus be as follows:

| $\gamma_n$ | A [dB] |
|---|---|
| 1 | 6.7 |
| 1.2 | 7.8 |
| 1.4 | 8.8 |
| 1.6 | 9.7 |
| 1.8 | 10.6 |
| 2.0 | 11.4 |
| 4.0 | 17.0 |

As can be seen, in order to reach noise suppression of e.g. 10 dB or more, large oversubtraction factors are needed.

Considering next the impact of noise subtraction on the remaining speech amplitude,
we have $$|Z(t_k,\omega_l)| \leq |Z_s(t_k,\omega_l)| + |Z_n(t_k,\omega_l)|$$

Thus, subtraction of the noise component from $|Z(t_k,\omega_l)|$ will easily lead to oversubtraction even for $\gamma_n$ as low as one.

Figure 2:
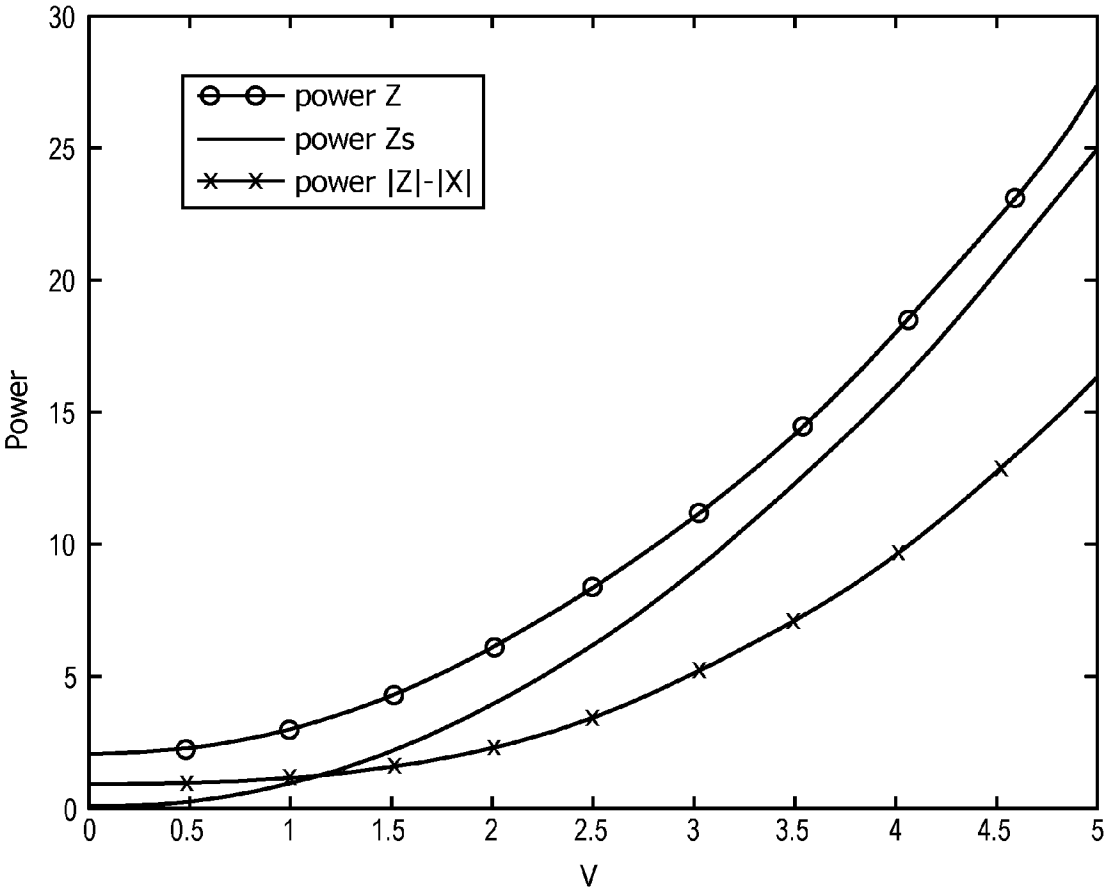
FIG. 2 illustrates an example of noise suppression performance for a prior art noise suppressor.

The powers of $|Z(t_k,\omega_l)|$ and $(|Z(t_k,\omega_l)|-|Z_s(t_k,\omega_l)|)$ as a function of the speech amplitude $\upsilon=|Z(t_k,\omega_l)|$ and the noise power ($\sigma^{-2}$) may be calculated (or determined by simulation or numerical analysis). FIG. 2 illustrates the result where $\sigma^{-2}=1$.

As can be seen from FIG. 2, for large $\upsilon$ the powers of $|Z(t_k,\omega_l)|$ and $|Z_s(t_k,\omega_l)|$ approach each other. As a result, subtraction of the noise estimate $IX(t_k,\omega_l)|$ will lead to oversubtraction.

If we define the speech attenuation as:

$$A_s = -10\log\frac{E\{(|Z(t_k,\omega_l)| - |X(t_k,\omega_l)|)^2\}}{E\{|Z_s(t_k,\omega_l)|\}^2}$$

then for $\nu>2$ the speech attenuation is around 2 dB. For smaller $\nu$, especially $\upsilon<1$, not all noise is suppressed, due to the large variance in $d_s=|Z(t_k,\omega_l)|-|X(t_k,\omega_l)|$. For those values $d_s$ might be negative and as is the case with noise only, the values will be clipped such that $\theta\geq 0$. For larger $\nu$, $d_s$ will not be negative and bounding to zero does not affect the performance.

Figure 3:
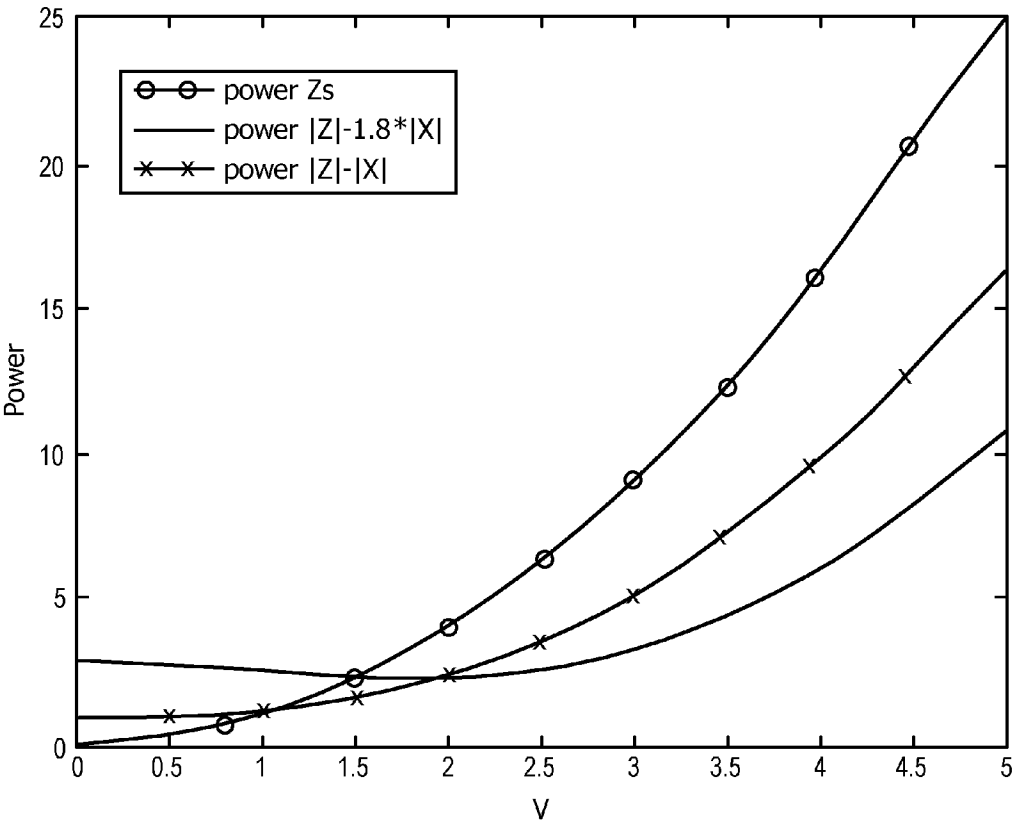
FIG. 3 illustrates an example of noise suppression performance for a prior art noise suppressor.

If we increase the oversubtraction factor $\gamma_n$, the speech attenuation will increase as is shown in FIG. 3 which corresponds to FIG. 1 but with the power $E\{(|Z(t_k,\omega_l)|-\gamma_n|X(t_k,\omega_l)|)^2\}$ being given for $\gamma_n=1$ and $\gamma_n=1.8$ respectively, and compared with the desired output.

For $\upsilon>2$ we see an increase in speech distortion ranging from 4 to 5 dB. For $\upsilon<2$ the output increases for $\gamma_n=1.8$. This could be prevented by bounding to zero as discussed before.

The 4 dB gain in noise suppression when going from $\gamma_n=1$ to $\gamma_n=1.8$ is offset by 2 to 3 dB more speech attenuation thus leading to an SNR improvement of only around 1 to 2 dB. This is typical for diffuse-like noise fields. The total SNR improvement is limited to around 12 dB.

Thus, whereas the approach may result in improved SNR and indeed in effective noise suppression, this suppression is still in practice restricted to relatively modest SNR improvements of not much more than 10 dB.

Figure 4:
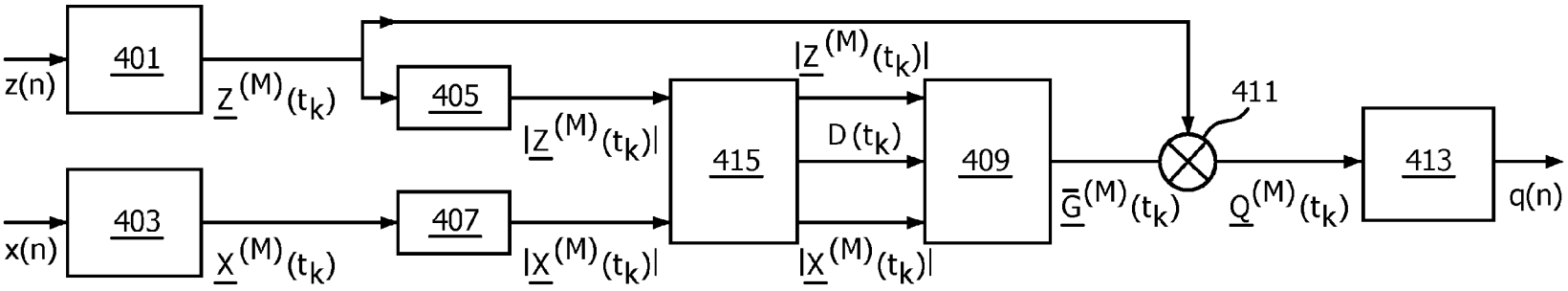
FIG. 4 is an illustration of an example of a noise suppressor in accordance with some embodiments of the invention.

FIG. 4 illustrates an example of a noise suppressor in accordance with some embodiments of the invention. The noise suppressor of FIG. 4 may provide substantially higher SNR improvements for diffuse noise than is typically possible with the system of FIG. 1. Indeed, simulations and practical tests have demonstrated that SNR improvements in excess of 20-30 dB are typically possible.

The noise suppressor comprises a first transformer 401 which receives a first microphone signal from a microphone (not shown). The first microphone signal may be captured, filtered, amplified etc. as known in the prior art. Furthermore, the first microphone signal may be a digital time domain signal generated by sampling an analog signal.

The first transformer 401 is arranged to generate a first frequency domain signal by applying a frequency transform to the first microphone signal. Specifically, the first microphone signal is divided into time segments/intervals. Each time segment/interval comprises a group of samples which are transformed, e.g. by an FFT, into a group of frequency domain samples. Thus, the first frequency domain signal is represented by frequency domain samples where each frequency domain sample corresponds to a specific time interval and a specific frequency interval. Each such frequency interval and time interval is typically in the field known as a time frequency tile. Thus, the first frequency domain signal is represented by a value for each of a plurality of time frequency tiles, i.e. by time frequency tile values.

The noise suppressor further comprises a second transformer 403 which receives a second microphone signal from a microphone (not shown). The second microphone signal may be captured, filtered, amplified etc. as known in the prior art. Furthermore, the second microphone signal may be a digital time domain signal generated by sampling an analog signal.

The second transformer 403 is arranged to generate a second frequency domain signal by applying a frequency transform to the second microphone signal. Specifically, the second microphone signal is divided into time segments/intervals. Each time segment/interval comprises a group of samples which are transformed, e.g. by an FFT, into a group of frequency domain samples. Thus, the second frequency domain signal is represented a value for each of a plurality of time frequency tiles, i.e. by time frequency tile values.

The first and second microphone signals are in the following referred to as z(n) and x(n) respectively and the first and second frequency domain signals are referred to by the vectors $\underline{Z}^{(M)}(t_k)$ and $\underline{X}^{(M)}(t_k)$ (each vector comprising all M frequency tile values for a given processing/transform time segment/frame).

When in use, z(n) is assumed to comprise noise and speech whereas x(n) is assumed to comprise noise only. Furthermore, the noise components of z(n) and x(n) are assumed to be uncorrelated (The components are assumed to be uncorrelated in time. However, there is assumed to typically be a relation between the average amplitudes and this relation is represented by the coherence term).

Such assumptions tend to be valid in scenarios wherein the first microphone (capturing z(n)) is positioned very close to the speaker whereas the second microphone is positioned at some distance from the speaker, and where the noise is e.g. distributed in the room. Such a scenario is exemplified in FIG. 5, wherein the noise suppressor is depicted as a SUPP unit.

Following the transformation to the frequency domain, the real and imaginary components of the time frequency values are assumed to be Gaussian distributed. This assumption is typically accurate e.g. for scenarios with noise originating from diffuse sound fields, for sensor noise, and for a number of other noise sources experienced in many practical scenarios.

Figure 6:
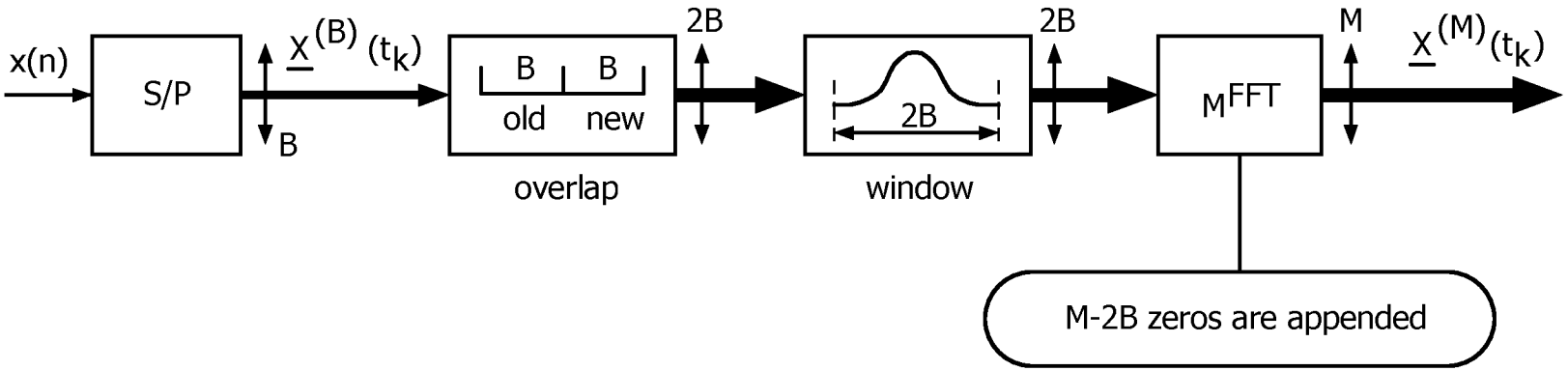
FIG. 6 illustrates an example of a time domain to frequency domain transformer.

FIG. 6 illustrates a specific example of functional elements of possible implementations of the first and second transform units 401, 403. In the example, a serial to parallel converter generates overlapping blocks (frames) of 2B samples which are then Hanning windowed and converted to the frequency domain by a Fast Fourier Transform (FFT).

The first transformer 401 is coupled to a first magnitude unit 405 which determines the magnitude values of the time frequency tile values thus generating magnitude time frequency tile values for the first frequency domain signal.

Similarly, the second transformer 403 is coupled to a second magnitude unit 407 which determines the magnitude values of the time frequency tile values thus generating magnitude time frequency tile values for the second frequency domain signal.

The first and second magnitude units 405, 407 are fed to a gain unit 409 which is arranged to determine gains for the time frequency tiles based on the magnitude time frequency tile values of the first frequency domain signal and magnitude time frequency tile values of the second frequency domain signal. The gain unit 409 thus calculates time frequency tile gains which in the following are referred to by the vectors $\underline{G}^{(M)}(t_k)$.

The gain unit 409 specifically determines a difference measure indicative of a difference between time frequency tile values of the first frequency domain signal and predicted time frequency tile values of the first frequency domain signal generated from the time frequency tile values of the second frequency domain signal. The difference measure may thus specifically be a prediction difference measure. In some embodiments, the prediction may simply be that the time frequency tile values of the second frequency domain signal are a direct prediction of the time frequency tile values of the first frequency domain signal.

The gain is then determined as a function of the difference measure. Specifically, a difference measure may be determined for each time frequency tile and the gain may be set such that the higher the difference measure (i.e. the stronger indication of difference) the higher the gain. Thus, the gain may be determined as a monotonically increasing function of the distance measure.

As a result, time frequency tile gains are determined with gains being lower for time frequency tiles for which the difference measure is relatively low, i.e. for time frequency tiles where the value of the first frequency domain signal can relatively accurately be predicted from the value of the second frequency domain signal, than for time frequency tiles for which the difference measure is relatively low, i.e. for time frequency tiles where the value of the first frequency domain signal cannot effectively be predicted from the value of the second frequency domain signal. Accordingly, gains for time frequency tiles where there is high probability of the first frequency domain signal containing a significant speech component are determined as higher than gains for time frequency tiles where there is low probability of the first frequency domain signal containing a significant speech component. The generated time frequency tile gains are in the example scalar values.

The gain unit 409 is coupled to a scaler 411 which is fed the gains, and which proceeds to scale the time frequency tile values of the first frequency domain signal by these time frequency tile gains. Specifically, in the scaler 411, the signal vector $\underline{Z}^{(M)}(t_k)$ is elementwise multiplied by the gain vector $\underline{G}^{(M)}(t_k)$ to yield the resulting signal vector $\underline{Q}^{(M)}(t_k)$ The scaler 411 thus generates a third frequency domain signal, also referred to as an output frequency domain signal, which corresponds to the first frequency domain signal but with a spectral shaping corresponding to the expected speech component. As the gain values are scalar values, the individual time frequency tile values of the first frequency domain signal may be scaled in amplitude but the time frequency tile values of the third frequency domain signal will have the same phase as the corresponding values of the first frequency domain signal.

The gain unit 409 is coupled to an optional third transformer 413 which is fed the third frequency domain signal. The third transformer 413 is arranged to generate an output signal from a frequency to time transform of the third frequency domain signal. Specifically, the third transformer 413 may perform the inverse transform of the transform of the first frequency domain signal by the first transformer 401. In some embodiments, the third (output) frequency domain signal may be used directly, e.g. by frequency domain speech recognition or speech enhancement. In such embodiments, there is accordingly no need for the third transformer 413.

Figure 7:
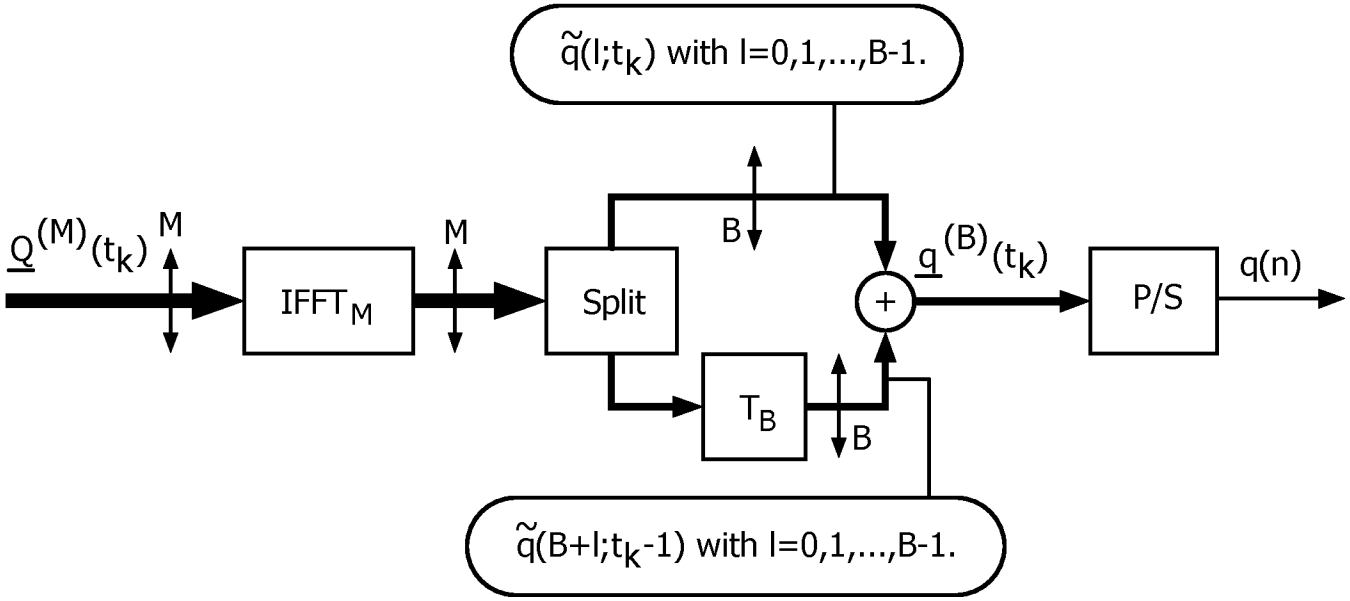
FIG. 7 illustrates an example of a frequency domain to time domain transformer.

Specifically, as illustrated in FIG. 7, the third frequency domain signal $\underline{Q}^{(M)}(t_k)$ may be transformed back to the time domain and then, because of the overlapping and windowing of the first microphone signal by the first transformer 401, the time domain signal may be reconstructed by adding the first B samples of the current (newest) frame (transform segment) with the last B samples of the previous frame. Finally the resulting block $\underline{q}^{(B)}(t_k)$ can be transformed into a continuous output signal stream q(n) by a parallel to serial converter.

However, the noise suppressor of FIG. 4 does not base the calculation of the time frequency tile gains on only the difference measures. Rather, the noise suppressor is arranged to designate time frequency tiles as being speech (time frequency) tiles or being noise (time frequency tiles), and to determine the gains in dependence on the designation of the designation. Specifically, the function for determining a gain for a given time frequency tile as a function of the difference measure will be different if the time frequency tile is designated as belonging to a speech frame than if it is designated as a belonging to a noise frame.

The noise suppressor of FIG. 4 specifically comprises a designator 415 which is arranged to designate time frequency tiles of the first frequency domain signal as speech tiles or noise tiles.

It will be appreciated that many different approaches and techniques exist for determining whether signal components correspond to speech or not. It will further be appreciated that any such approach may be used as appropriate, and for example time frequency tiles belonging to a signal part may be designated as speech time frequency tiles if it is estimated that the signal part comprise speech components and as noise otherwise.

Thus, in many embodiments the designation of time frequency tiles is into speech and non-speech tiles. Indeed, noise tiles may be considered equivalent to non-speech tiles (indeed as the desired signal component is a speech component, all non-speech can be considered to be noise).

In many embodiments, the designation of time frequency tiles as speech or noise (time frequency) tiles may be based on a comparison of the first and second microphone signals, and/or a comparison of the first and second frequency domain signals. Specifically, the closer the correlation between the amplitude of the signals, the less likely it is that the first microphone signal comprises significant speech components.

It will be appreciated that the designation of the time frequency tiles as speech or noise tiles (where each category in some embodiments may comprise further subdivisions into subcategories) may in some embodiments be performed individually for each time frequency tile but may also in many embodiments be performed in groups of time frequency tiles.

Specifically, in the example of FIG. 4, the designator 415 is arranged to generate one designation for each time segment/transform block. Thus, for each time segment, it may be estimated whether the first microphone signal comprises a significant speech component or not. If so, all time frequency tiles of that time segment are designated as speech time frequency tiles and otherwise they are designated as noise time frequency tiles.

In the specific example of FIG. 4, the designator 415 is coupled to the first and second magnitude units 405, 407 and is arranged to designate the time frequency tiles based on the magnitude values of the first and second frequency domain signals. However, it will be appreciated that in many embodiments, the designation may alternatively or additionally be based on e.g. the first and second microphone signal and/or the first and second frequency domain signal.

The designator 415 is coupled to the gain unit 409 which is fed the designations of the time frequency tiles, i.e. the gain unit 409 receives information as to which time frequency tiles are designated as speech tiles and which time frequency tiles are designated as noise tiles.

The gain unit 409 is arranged to calculate the time frequency tile gains in response to the designation of the time frequency tiles of the first frequency domain signal as speech tiles or noise tiles.

Thus, the gain calculation is dependent on the designation, and the resulting gain will be different for time frequency tiles that are designated as speech tiles than for time frequency tiles that are designated as noise tiles. This difference or dependency may for example be implemented by the gain unit 409 by this having two alternative algorithms or functions for calculating a gain value from a difference measure and being arranged to select between these two functions for the time frequency tiles based on the designation. Alternatively or additionally, the gain unit 409 may use different parameter values for a single function with the parameter values being dependent on the designation.

The gain unit 409 is arranged to determine a lower gain value for a time frequency tile gain when the corresponding time frequency tile is designated as a noise tile than when it is designated as a speech tile. Thus, if all other parameters used to determine the gains are unchanged, the gain unit 409 will calculate a lower gain value for a noise tile than for a speech tile.

In the specific example of FIG. 4, the designation is segment/frame based, i.e. the same designation is applied to all time frequency tiles of a time segment/frame. Accordingly, the gains for the time segments/frames estimated to comprise sufficient speech are set higher than for the time segments estimated not to comprise sufficient speech (all other parameters being equal).

In many embodiments, the difference value for a time frequency tile may be dependent on whether the time frequency tile is designated as a noise tile or a speech tile. Thus, in some embodiments, the same function may be used to calculate the gain from a difference measure, but the calculation of the difference measure itself may depend on the designation of the time frequency tiles.

In many embodiments, the difference measure may be determined as a function of the magnitude time frequency tile values of the first and second frequency domain signals respectively.

Indeed, in many embodiments, the difference measure may be determined as a difference between a first and a second value wherein the first value is generated as a function of at least one time frequency tile value of the first frequency domain signal and the second value is generates as a function of at least one time frequency tile value of the second frequency domain signal. However, the first value may not be dependent on the at least one time frequency tile value of the second frequency domain signal, and the second value may not be dependent on the at least one time frequency tile value of the first frequency domain signal.

A first value for a first time frequency tile may specifically be generated as a monotonically increasing function of the magnitude time frequency tile value of the first frequency domain signal in the first time frequency tile. Similarly, a second value for the first time frequency tile may specifically be generated as a monotonically increasing function of the magnitude time frequency tile value of the second frequency domain signal in the second time frequency tile.

At least one of the functions for calculating the first and second values may be dependent on whether the time frequency tile is designated as a speech time frequency tile or a noise time frequency tile. For example, the first value may be higher if the time frequency tile is a speech tile than if it is a noise tile. Alternatively or additionally, the second value may be lower if the time frequency tile is a speech tile than if it is a noise tile.

A specific example of a function for calculating the gain function may specifically be the following function:

$$G(t_k, \omega_l) = \frac{|Z(t_k, \omega_l)| - \gamma_n C(t_k, \omega_l)|X(t_k, \omega_l)|}{|Z(t_k, \omega_l)|},$$

for a noise frame $$G(t_k, \omega_l) = \frac{|Z(t_k, \omega_l)| - \gamma_s \cdot \alpha \cdot C(t_k, \omega_l)|X(t_k, \omega_l)|}{|Z(t_k, \omega_l)|},$$

for a speech frame where $\alpha$ is a factor that is lower than unity, $C(t_k,\omega_l)$ is an estimated coherence term representing correlation between the amplitudes of the first frequency domain signal and the amplitudes of the second frequency domain signal, and the oversubtraction factor $\gamma_n$ is a design parameter. For some applications $C(t_k,\omega_l)$ can be approximated as one. The oversubtraction factor $\gamma_n$ is typically in the range of 1 to 2.

Typically, the gain function is limited to positive values, and typically a minimum gain value is set. Thus, the functions may be determined as:

$$G(t_k, \omega_l) = \mathrm{MAX}\left(\frac{|Z(t_k, \omega_l)| - \gamma_n C(t_k, \omega_l)|X(t_k, \omega_l)|}{|Z(t_k, \omega_l)|}, \theta\right),$$

$$G(t_k, \omega_l) = \mathrm{MAX}\left(\frac{|Z(t_k, \omega_l)| - \gamma_s \cdot \alpha \cdot C(t_k, \omega_l)|X(t_k, \omega_l)|}{|Z(t_k, \omega_l)|}, \theta\right),$$

This may allow the maximum attenuation of the noise suppression to be set by $\theta$ which must be equal or larger than 0. If for example the minimum gain value is set to $\theta=0.1$, then the maximum attenuation is 20 dB. Since the unbounded gain function would be lower (in practice between 30 and 40 dB), this result in a more natural sounding background noise, which is in particular appreciated for communication applications.

In the example, the gain is thus determined as a function of a numerator which is a difference measure. Furthermore, the difference measure is determined as the difference between two terms (values). The first term/value is a function of the magnitude of the time frequency tile value of the first frequency domain signal. The second term/value is a function of the magnitude of the time frequency tile value of the second frequency domain signal. Furthermore, the function for calculating the second value is further dependent on whether the time frequency tile is designated as a noise or speech time frequency tile (i.e. it is dependent on whether the time frequency tile is part of a noise or speech frame). In the example, the gain unit 409 is arranged to determine a noise coherence estimate C $(t_k,\omega_l)$ indicative of a correlation between the amplitude of the second microphone signal and the amplitude of a noise component of the first microphone signal. The function for determining the second value (or in some cases the first value) is in this case dependent on this noise coherence estimate. This allows a more appropriate determination of an appropriate gain value since the second value more accurately reflects the expected or estimated noise component in the first frequency domain signal.

It will be appreciated that any suitable approach for determining the noise coherence estimate $C(t_k,\omega_l)$ may be used. For example, a calibration may be performed where the speaker is instructed not to speak with the first and second frequency domain signal being compared and with the noise correlation estimate $C(t_k,\omega_l)$ for each time frequency tile simply being determined as the average ratio of the time frequency tile values of the first frequency domain signal and the second frequency domain signal.

In many embodiments, the dependency on the gain of whether a time frequency tile is designated as a speech tile or as a noise tile is not a constant value but is itself dependent on one or more parameters. For example, the factor $\alpha$ may in some embodiments not be constant but rather may be a function of characteristics of the receive signals (whether direct or derived characteristics).

In particular, the gain difference may be dependent on at least one of a signal level of the first microphone signal; a signal level of the second microphone signal; and a signal to noise estimate for the first microphone signal. These values may be average values over a plurality of time frequency tiles, and specifically over a plurality of frequency values and a plurality of segments. They may specifically be (relatively long term) measures for the signals as a whole. In some embodiments, the factor $\alpha$ may be given as $$\alpha = f(-v^2/2\sigma^2)$$

where $v$ is the amplitude of the first microphone signal and $\sigma^2$ is the energy/variance of the second microphone signal. Thus, in this example a is dependent on a signal to noise ratio for the first microphone signal. This may provide improved perceived noise suppression. In particular, for low signal to noise ratios, a strong noise suppression is performed thereby improving e.g. intelligibility of the speech in the resulting signal. However, for higher signal to noise ratios, the effect is reduced thereby reducing distortion.

Thus, the function $f(-v^2/2\sigma^2)$ can be determined and used to adapt the calculation of the gains for speech signals. The function depends on $(-v^2/2\sigma^2)$, which corresponds to the SNR: i.e. the energy of the speech signal $v^2$ versus the noise energy $2\sigma^2$.

It will be appreciated different functions and approaches for determining gains based on the difference between magnitudes of the first and second microphone signals and on the designation of the tiles as speech or noise may be used in different embodiments.

Indeed, whereas the previously described specific approaches may provide particularly advantageous performance in many embodiments, many other functions and approaches may be used in other embodiments depending on the specific characteristics of the application.

The difference measure may be calculated as:

$$d(t_k,\omega_l) = f_1(|Z(t_k,\omega_l)|) - f_2(|X(t_k,\omega_l)|)$$

where $f_1(x)$ and $f_2(x)$ can be selected to be any monotonic functions suiting the specific preferences and requirements of the individual embodiment. Typically, the functions $f_1(x)$ and $f_2(x)$ will be monotonically increasing functions.

Thus, the difference measure is indicative of a difference between a first monotonic function $f_1(x)$ of a magnitude time frequency tile value of the first frequency domain signal and a second monotonic function $f_1(x)$ of a magnitude time frequency tile value of the second frequency domain signal. In some embodiments, the first and second monotonic functions may be identical functions. However, in most embodiments, the two functions will be different.

Furthermore, one or both of the functions $f_1(x)$ and $f_2(x)$ may be dependent on various other parameters and measures, such as for example an overall averaged power level of the microphone signals, the frequency, etc.

In many embodiments, one or both of the functions $f_1(x)$ and $f_2(x)$ may be dependent on signal values for other frequency tiles, for example by an averaging of one or more of $Z(t_k,\omega_l)$, $|Z(t_k,\omega_l)|$, $f_1(|Z(t_k,\omega_l)|)$, $X(t_k,\omega_l)$, $|X(t_k,\omega_l)|$, or $f_2(|X(t_k,\omega_l)|)$ over other tiles in in the frequency and/or time dimension (i.e. averaging of values for varying indexes of k and/or L). In many embodiments, an averaging over a neighborhood extending in both the time and frequency dimensions may be performed. Specific examples based on the specific difference measure equations provided earlier will be described later but it will be appreciated that corresponding approaches may also be applied to other algorithms or functions determining the difference measure.

Examples of possible functions for determining the difference measure include for example:

$$d(t_k,\omega_l) = |Z(t_k,\omega_l)|^{\alpha} - \gamma \cdot |X(t_k,\omega_l)|^{\beta}$$

where $\alpha$ and $\beta$ are design parameters with typically $\alpha=\beta$, such as e.g. in:

$$d(t_k, \omega_l) = \sqrt{|Z(t_k, \omega_l)|} - \gamma \cdot \sqrt{|X(t_k, \omega_l)|};$$

$$d(t_k, \omega_l) = \sum_{n=k-4}^{k+3} |Z(t_n, \omega_l)| - \gamma \cdot \sum_{n=k-4}^{k+3} |X(t_k, \omega_l)|$$

$$d(t_k, \omega_l) = |Z(t_k, \omega_l)| - \gamma \cdot |X(t_k, \omega_l)| \cdot \sigma(\omega_l)$$

where $\sigma(\omega_l)$ is a suitable weighting function used to provide desired spectral characteristics of the noise suppression (e.g. it may be used to increase noise suppression for e.g. higher frequencies which are likely to contain a relatively high amount of noise energy but relatively little speech energy and to reduce noise suppression for midband frequencies which are likely to contain a relatively high amount of speech energy but possibly relatively little noise energy). Specifically, $\sigma(\omega_l)$ may be used to provide the desired spectral characteristics of the noise suppression while keeping the spectral shaping of the speech to a low level.

It will be appreciated that these functions are merely exemplary and that many other equations and algorithms for calculating a distance measure indicative of difference between the magnitudes of the two microphone signals can be envisaged.

In the above equations, the factor $\gamma$ represents a factor which is introduced to bias the difference measure towards negative values. It will be appreciated that whereas the specific examples introduce this bias by a simple scale factor applied to the second microphone signal time frequency tile, many other approaches are possible.

Indeed, any suitable way of arranging the first and second functions $f_1(x)$ and $f_2(x)$ in order to provide a bias towards negative values for at least noise tiles may be used. The bias is specifically, as in the previous examples, a bias that will generate expected values of the difference measure which are negative if there is no speech. Indeed, if both the first and second microphone signals contain only random noise (e.g. the sample values may be symmetrically and randomly distributed around a mean value), the expected value of the difference measure will be negative rather than zero. In the previous specific example, this was achieved by the oversubtraction factor $\gamma$ which resulted in negative values when there is no speech.

In order to compensate for differences in the signal levels of the first and the second microphone when no speech is present, the gain unit may as previously described determine a noise coherence estimate which is indicative of a correlation between an amplitude of the second microphone signal and an amplitude of a noise component of the first microphone signal. The noise coherence estimate may for example be generated as an estimate of the ratio between the amplitude of the first microphone signal and the second microphone signal. The noise coherence estimate may be determined for individual frequency bands, and may specifically be determined for each time frequency tile. Various techniques for estimating amplitude/magnitude relationships between two microphone signals are known to the skilled person and will not be described in further detail. For example, average amplitude estimates for different frequency bands may be determined during time intervals with no speech (e.g. by a dedicated manual measurement or by automatic detection of speech pauses).

In the system, at least one of the first and second monotonic functions $f_1(x)$ and $f_2(x)$ may compensate for the amplitude differences. In the previous example, the second monotonic function compensated for the amplitude differences by scaling the magnitude values of the second microphone signal by the value $C(t_k,\omega_l)$. In other embodiments, the compensation may alternatively or additionally be performed by the first monotonic function, e.g. by scaling magnitude values of the first microphone signal by $1/C(t_k,\omega_l)$.

Furthermore, in most embodiments, the first monotonic function and the second monotonic function are such that a negative expected value for the difference measure is generated if an amplitude relationship between the first microphone signal and the second microphone signal corresponds to the estimated correlation, and if the time frequency tile is designated as a noise tile.

Specifically, the noise coherence estimate may indicate that an estimated or expected magnitude difference between the first microphone signal and the second microphone signal (and specifically for the specific frequency band) corresponds to the ratio given by the value of $C(t_k,\omega_l)$. In such a case, the first monotonic function and the second monotonic function are selected such that if the corresponding time frequency tile values have magnitude values that are equal to $C(t_k,\omega_l)$ (and if the time frequency tile is designated a noise tile) then the generated difference measure will be negative.

E.g., the noise coherence estimate may be determined as:

$$C(t_k, \omega_l) = \frac{E\{|Z_n(t_k, \omega_l)|\}}{E\{|X_n(t_k, \omega_l)|\}},$$

(In practice, the value may be generated by averaging of a suitable number of values, e.g. in different time frames).

In such a case, the first and second monotonic functions $f_1(x)$ and $f_2(x)$ is selected with the property that if $$\frac{|Z(t_k, \omega_l)|}{|X(t_k, \omega_l)|} = C(t_k, \omega_l)$$

then the difference measure $d(t_k,\omega_l)$ will have a negative value (when designated a noise tile), i.e. the first and second monotonic functions $f_1(x)$ and $f_2(x)$ are selected such that for noise tiles $$d(t_k, \omega_l) < 0 \text{ for } \frac{|Z(t_k, \omega_l)|}{|X(t_k, \omega_l)|} = C(t_k, \omega_l)$$

In the previous specific example, this was achieved by the difference measure $$d(t_k,\omega_l)=|Z(t_k,\omega_l)|-\gamma_n C(t_k,\omega_l)|X(t_k,\omega_l)|$$

comprising an oversubtraction factor $\gamma_n$ with a value higher than unity.

In this specific example, $f_1(x)=x$ and $f_2(x)=\gamma_n C(t_k,\omega_l)x$ but it will be appreciated that an infinite amount of other monotonic functions exist and may be used instead. Further, in the example, the compensation for noise level differences between the first and second microphone signals, as well as the bias towards negative difference measure values, is achieved by including compensation factors in the second monotonic function $f_2(x)$. However, it will be appreciated that in other embodiments, this may alternatively or additionally be achieved by including compensation factors in the first monotonic function $f_1(x)$.

Furthermore, in the described approach, the gain is dependent on whether the time frequency tile is designated as a speech or noise tile. In many embodiments, this may be achieved by the difference measure being dependent whether on the time frequency tile is designated as a speech or noise tile.

Specifically, the gain unit may be arranged to vary at least one of the first monotonic function and the second monotonic function such that the expected value of the difference measure if the time frequency tile magnitude values actually correspond to the noise coherence estimate is different dependent on whether the time frequency tile is designated as a speech tile or a noise tile.

As an example, the expected value for the difference measure when the relative noise levels between the two microphone signals are as expected in accordance with the noise coherence estimate may be a negative value if the tile is designated as a noise tile but zero if the tile is designated as a speech tile.

In many embodiments, the expected value may be negative for both speech and noise tiles but with the expected value being more negative (i.e. higher absolute value/magnitude) for a noise tile than for a speech tile.

In many embodiments, the first and second monotonic functions $f_1(x)$ and $f_2(x)$ may include a bias value which is changed dependent on whether the tile is a speech or noise tile. As a specific example, the previous specific example used the difference measure given by $$|Z(t_k,\omega_l)|-\gamma_n C(t_k,\omega_l)|X(t_k,\omega_l)|, \quad \text{for a noise frame}$$

and $$|Z(t_k,\omega_l)|-\gamma_s\cdot\alpha\cdot C(t_k,\omega_l)|X(t_k,\omega_l), \quad \text{for a speech frame}$$

where $\gamma_n>\gamma_s$.

Alternatively, the difference measure may in this example be expressed as:

$$d(t_k,\omega_l)=|Z(t_k,\omega_l)|-\gamma(D(t_k,\omega_l))\cdot C(t_k,\omega_l)|X(t_k,\omega_l)|$$

where D $(t_k,\omega_l)$ is a value indicating whether the tile is a noise tile or speech tile.

For completeness, it is noted that a requirement for the difference measure to be calculated to have specific properties for specific values/properties of the input signal values provides an objective criterion for the actual functions used, and that this criterion is not dependent on any actual signal values or on actual signals being processed. Specifically, requiring that $$d(t_k,\omega_l)=f_1(|Z(t_k,\omega_l)|)-f_2(|X(t_k,\omega_l)|)<0 \text{ for } \frac{|Z(t_k,\omega_l)|}{|X(t_k,\omega_l)|}=C(t_k,\omega_l)$$

provides a limiting criterion for functions used.

It will be appreciated that many different functions and approaches for determining gains based on the difference measure may be used in different embodiments. In order to avoid phase inversion and associated degradation, the gain is generally restricted to non-negative values. In many embodiments, it may be advantageous to restrict the gain to not fall below a minimum gain (thereby ensuring that no specific frequency band/tile is completely attenuated).

For example, in many embodiments, the gain may simply be determined by scaling the difference measure while ensuring that the gain is kept above a certain minimum gain (which may specifically be zero to ensure that the gain is non-negative), such as e.g.:

$$G(t_k,\omega_l)=\mathrm{MAX}(\varphi\cdot d(t_k,\omega_l),\theta)$$

where $\varphi$ is a suitable selected scale factor for the specific embodiment (e.g. determined by trial and error), and $\theta$ is a non-negative value.

In many embodiments, the gain may be a function of other parameters. For example, in many embodiments, the gain may be dependent on a property of at least one of the first and second microphone signals. In particular, the scale factor may be used to normalize the difference measure. As a specific example, the gain may be determined as:

$$G(t_k,\omega_l)=\mathrm{MAX}\left(\frac{d(t_k,\omega_l)}{|Z(t_k,\omega_l)|},\theta\right)$$

i.e. with $$\varphi(t_k,\omega_l)=\frac{1}{|Z(t_k,\omega_l)|}$$

and e.g. with $$d(t_k,\omega_l)=|Z(t_k,\omega_l)|-\gamma(D(t_k,\omega_l))\cdot C(t_k,\omega_l)|X(t_k,\omega_l)|$$

(corresponding to the previous specific examples by setting $$d(t_k,\omega_l)=|Z(t_k,\omega_l)|-\gamma_n C(t_k,\omega_l)|X(t_k,\omega_l)|, \quad \text{for a noise frame}$$

$$d(t_k,\omega_l)=|Z(t_k,\omega_l)|-\gamma_s\cdot\alpha\cdot C(t_k,\omega_l)|X(t_k,\omega_l)|, \quad \text{for a speech frame).}$$

Thus, the gain calculation may include a normalization.

In other embodiments, more complex functions may be used. For example, a non-linear function for determining the gain as a function of the difference measure may be used, such as e.g.

$$G(t_k,\omega_l)=\mathrm{MAX}(\delta\cdot\log d(t_k,\omega_l),\theta)$$

where $\delta$ may be a constant.

In general, the gain may be determined as any non-negative function of the difference measure:

$$G(t_k,\omega_l)=f_3(d(t_k,\omega_l))$$

Typically, the gain may be determined as a monotonic function of the difference measure, and specifically as a monotonically increasing function. Thus, typically a higher gain will result when the difference measure indicates a larger difference between the first and second microphone signals thereby reflecting increased probability that the time frequency tile contains a high amount of speech (which is predominantly captured by the first microphone signal positioned close to the speaker).

Similarly to the algorithm or function for determining the difference measure, the function for determining the gain may further be dependent on other parameters or characteristics. Indeed, in many embodiments the gain function may be dependent on a characteristic of one or both of the first and second microphone signals. E.g., as previously described, the function may include a normalization based on the magnitude of the first microphone signal.

Other examples of possible functions for calculating the gain from the difference measure may include:

$$G(t_k,\omega_l)=\sqrt{\mathrm{MAX}(d(t_k,\omega_l),\theta)}$$

$$G(t_k,\omega_l)=\mathrm{MAX}\left(\frac{d(t_k,\omega_l)}{|Z(t_k,\omega_l)|}\cdot\sigma(\omega_l),\theta\right)$$

where $\alpha(\omega_l)$ is a suitable weighting function.

It will be appreciated that the exact approach for determining gains depending on the time frequency tile values and the designation as speech or noise tiles may be selected to provide the desired operational characteristics and performance for the specific embodiment and application.

Thus, the gain may be determined as $$G(t_k,\omega_l)=f_4(\alpha(t_k,\omega_l),d(t_k,\omega_l))$$

where $\alpha(t_k,\omega_l)$ reflects whether the tile is designated as a speech tile or a noise tile and $f_4$ may be any suitable function or algorithm that includes a component reflecting a difference between the magnitudes of the time frequency tile values for the first and second microphone signals.

The gain value for a time frequency tile is thus dependent on whether the tile is designated as a speech time frequency tile or a noise time frequency tile. Indeed, the gain is determined such that a lower gain value is determined for a time frequency tile when the time frequency tile is designated as a noise tile than when the time frequency tile is designated as a speech tile.

The gain value may be determined by first determining a difference measure and then determining the gain value from the difference measure. The dependency on the noise/speech designation may be included in the determination of the difference measure, in the determination of the gain from the difference measure, or in the determination of both the difference measure and the gain.

Thus, in many embodiments, the difference measure may be dependent on whether the time frequency tile is designated a noise frequency tile or a speech frequency tile. For example, one or both of the functions $f_1(x)$ and $f_2(x)$ described above may be dependent on a value which indicates whether the time frequency tile is designated as noise or speech.

The dependency may be such that (for the same microphone signal values), a larger difference measure is calculated when the time frequency tile is designated a speech tile than when it is designated a noise tile.

For example, in the specific example previously provided for the calculation of the gain $G(t_k,\omega_l)$, the numerator may be considered the difference measure and thus the difference measure is different dependent on whether the tile is designated a speech tile or a noise tile.

More generally, the difference measure may be indicated by:

$$d(t_k,\omega_l)=f_5(\alpha(t_k,\omega_l),f_1(|Z(t_k,\omega_l)|)-f_2(|X(t_k,\omega_l)|))$$

where $\alpha(t_k,\omega_l)$ is dependent on whether the tile is designated as a speech or noise tile, and where the function $f_5$ is dependent on a such that the difference measure is larger when $\alpha$ indicates that the tile is a speech tile than when it is a noise tile.

Alternatively or additionally, a function for determining the gain value from the difference measure may be dependent on the speech/noise designation. Specifically, the following function may be used:

$$G(t_k,\omega_l)=f_6(d(t_k,\omega_l),c(t_k,\omega_l))$$

where $\alpha(t_k,\omega_l)$ is dependent on whether the tile is designated as a speech or noise tile, and the function $f_6$ is dependent on a such that the gain is larger when $\alpha$ indicates that the tile is a speech tile than when it is a noise tile. As previously mentioned, any suitable approach may be used to designate time frequency tiles as speech tiles or noise tiles. However, in some embodiments, the designation may advantageously be based on difference values that are determined by calculating the difference measure under the assumption that the time frequency tile is a noise tile. Thus, the difference measure function for a noise time frequency tile can be calculated. If this difference measure is sufficiently low, it is indicative of the time frequency tile value of the first frequency domain signal being predictable from the time frequency tile value of the second frequency domain signal. This will typically be the case if the first frequency domain signal tile does not contain a significant speech component. Accordingly, in some embodiments, the tile may be designated as a noise tile if the difference measure calculated using the noise tile calculation is below a threshold. Otherwise, the tile is designated as speech tile.

Figure 8:
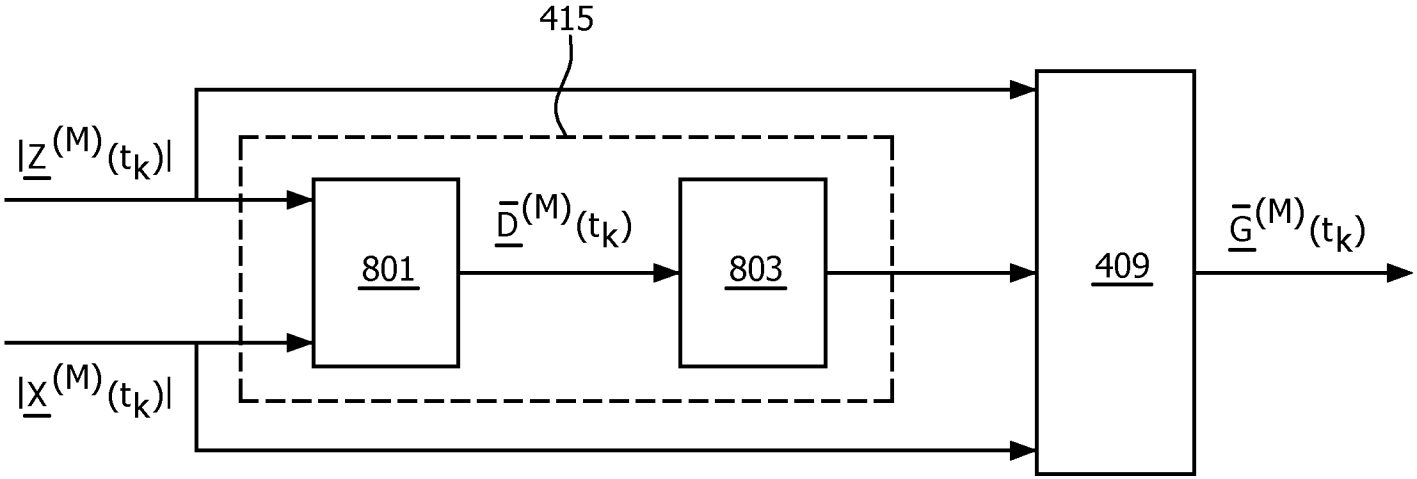
FIG. 8 is an illustration of an example of elements of a noise suppressor in accordance with some embodiments of the invention.

An example of such an approach is shown in FIG. 8. As illustrated, the designator 415 of FIG. 4 may comprise a difference unit 801 which calculates a difference value for the time frequency tile by evaluating the distance measure assuming that the time frequency tile is indeed a noise tile. The resulting difference value is fed to a tile designator 803 which proceeds to designate the tile as being a noise tile if the distance value is below a given threshold, and as a speech tile otherwise.

The approach provides for a very efficient and accurate detection and designation of tiles as speech or noise tiles. Furthermore, facilitated implementation and operation is achieved by re-using functionality for calculating the gains as part of the designator. For example, for all time frequency tiles that are designated as noise tiles, the calculated difference measure can directly be used to determine the gain. A recalculation of the difference measure is only required by the gain unit 409 for time frequency tiles that are designated as speech tiles.

In some embodiments, a low pass filtering/smoothing (/averaging) may be included in the designation based on the difference values. The filtering may specifically be across different time frequency tiles in both the frequency and time domain. Thus, filtering may be performed over time frequency tile difference values belonging to different (neighboring) time segments/frames as well as over multiple time frequency tiles in at least one of the time segments. The inventors have realized that such filtering may provide substantial performance improvements and a substantially improved designation and accordingly may provide a substantially improved noise suppression.

In some embodiments, a low pass filtering/smoothing (/averaging) may be included in the gain calculation. The filtering may specifically be across different time frequency tiles in both the frequency and time domain. Thus, filtering may be performed over time frequency tile values belonging to different (neighboring) time segments/frames as well as over multiple time frequency tiles in at least one of the time segments. The inventors have realized that such filtering may provide substantial performance improvements and a substantially improved perceived noise suppression.

The smoothing (i.e. the low pass filtering) may specifically be applied to the calculated gain values. Alternatively or additionally, the filtering may be applied to the first and second frequency domain signals prior to the gain calculation. In some embodiments, the filtering may be applied to parameters of the gain calculation, such as to the difference measures.

Specifically, in some embodiments the gain unit 409 may be arranged to filter gain values over a plurality of time frequency tiles where the filtering includes time frequency tiles differing in both time and frequency.

Specifically, the output values may be calculated using an averaged/smoothed version of the non-clipped gains:

$$Q(t_k,\omega_l)=\overline{G(t_k,\omega_l)}*|Z(t_k,\omega_l)|.$$

In some embodiments, the lower gain limit may be determined following the gain averaging, such as e.g. by calculating the output values as:

$$Q(t_k,\omega_l)=\mathrm{MAX}(\overline{G(t_k,\omega_l)},\theta)*|Z(t_k,\omega_l)|.$$

where $G(t_k,\omega_l)$ are calculated as a monotonic function of the difference measure but is not restricted to non-negative values. Indeed, the non-clipped gain may have negative values for the difference measure being negative.

In some embodiments, the gain unit may be arranged to filter at least one of the magnitude time frequency tile values of the first frequency domain signal and the magnitude time frequency tile values of the second frequency domain signal prior to these being used for calculating the gain values.

Thus, effectively, in this example, the filtering is performed on the input to the gain calculation rather than at the output.

Figure 9:
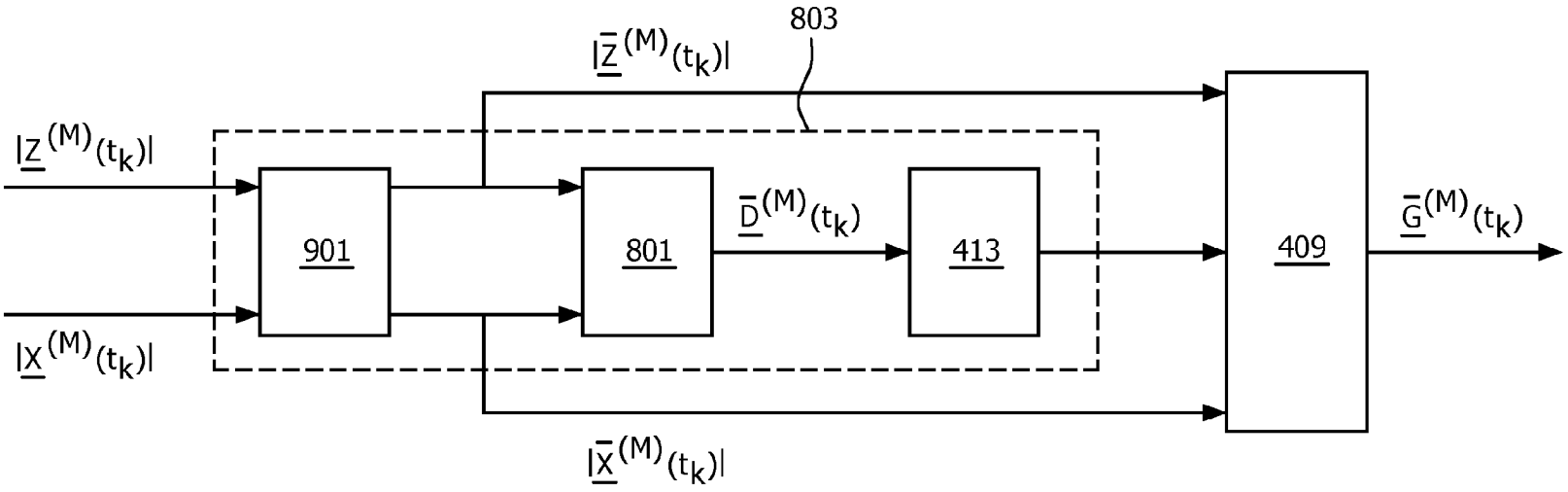
FIG. 9 is an illustration of an example of elements of a noise suppressor in accordance with some embodiments of the invention.

An example of this approach is illustrated in FIG. 9. The example corresponds to that of FIG. 8 but with the addition of a low pass filter 901 which performs a low pass filtering of the magnitudes of the time frequency tile values of the first and second frequency domain signal. In the example, the magnitude time frequency tile values $|\underline{Z}^{(\mathcal{M})}(t_k)|$ and $|\underline{X}^{(\mathcal{M})}(t_k)|$ are filtered to provide the smoothed vectors $|\underline{Z}^{(\mathcal{M})}(t_k)|$ and $|\underline{Z}^{(\mathcal{M})}(t_k)|$ (in the figure represented as $|^{(\mathcal{M})}(t_k)|$ and $|\underline{\check{X}}^{(\mathcal{M})}(t_k)|$).

In the example, the previously described functions for determining gain values may thus be replaced by:

$$G(t_k, \omega_l) = \mathrm{MAX}\left(\frac{|\overline{Z(t_k, \omega_l)}| - \gamma_n \overline{C(t_k, \omega_l)}|\overline{X(t_k, \omega_l)}|}{|\overline{Z(t_k, \omega_l)}|}, \theta\right),$$

and $$G(t_k, \omega_l) = \mathrm{MAX}\left(\frac{|\overline{Z(t_k, \omega_l)}| - \gamma_s f(-v^2/2\sigma^2)\overline{C(t_k, \omega_l)}|\overline{X(t_k, \omega_l)}|}{|\overline{Z(t_k, \omega_l)}|}, \theta\right)$$

for respectively noise and speech tiles, and where means smoothing (averaging) over neighboring values in the (t,ω)-plane.

The filtering may specifically use a uniform window like a rectangular window in time and frequency, or a window that is based on the characteristics of human hearing. In the latter case, the filtering may specifically be according to so-called critical bands. The critical band refers to the frequency bandwidth of the "auditory filter" created by the cochlea. For example octave bands or bark scale critical bands may be used.

The filtering may be frequency dependent. Specifically, at low frequencies, the averaging may be over only a few frequency bins, whereas more frequency bins may be used at higher frequencies.

The smoothing/filtering may be performed by averaging over neighboring values, such as e.g.:

$$\overline{|Z(t_k,\omega_l)|} = \Sigma_{m=0}{}^{2}\Sigma_{n=-1}{}^{N}|Z(t_{k-m},\omega_{l-n})| * W(m,n),$$

where e.g. for N=1, W(m,n) is a 3 by 3 matrix with weights of ⅑. N can also be dependent on the critical band and can then depend on the frequency index l. For higher frequencies, N will typically be larger than for lower frequencies.

In some embodiments, the filtering may be by filtering the difference measure, such as e.g. by calculating it as $|Z(t_k,\omega_l)| - \gamma_n \overline{C(t_k,\omega_l)}|\overline{X(t_k,\omega_l)}|$. As will be described in the following, the filtering/smoothing may provide substantial performance improvements.

Specifically, when filtering in the $(t_k,\omega_l)$ plane, the variance of especially the noise components in $|Z(t_k,\omega_l)|$ and $|X(t_k,\omega_l)|$ is reduced substantially.

If we have no speech, i.e. $|Z(t_k,\omega_l)| = |Z_n(t_k,\omega_l)|$ and assume $C(t_k,\omega_l)=1$, then we have:

$$\bar{d} = \overline{|Z(t_k,\omega_l)|} - \overline{|X(t_k,\omega_l)|},$$

where $|Z(t_k,\omega_l)|$ and $|X(t_k,\omega_l)|$ are smoothed over L independent values.

Smoothing does not change the mean, so we have:

$$E\{\bar{d}\} = 0.$$

The variance of the difference of two stochastic signals equals the sum of the individual variances:

$$\mathrm{var}(\bar{d}) = \frac{(4-\pi)\sigma^2}{L}.$$

If we bound $\bar{d}$ to zero then, since the distribution of $\bar{d}$ is symmetrical around zero, the power of $\bar{d}$ is half the value of the variance of $\bar{d}$:

$$E\{\bar{d}^2\} = \frac{4-\pi}{2L}\sigma^2.$$

If we now compare the power of the residual signal with the power of the input signal ($2\sigma^2$) we get for the noise suppression due to the noise suppressor:

$$A = -10\log_{10}\left(\frac{4-\pi}{4L}\right) = 6.68 + 10\log_{10}L\,\mathrm{dB}.$$

As an example, if we average over 9 independent values we have an extra 9.5 dB suppression.

Oversubtraction in combination with smoothing will increase the attenuation further. If we consider the variable $$\bar{d}_b = \mathrm{MAX}((\overline{|Z(t_k,\omega_l)|} - \gamma\overline{|X(t_k,\omega_l)|}),0),$$

smoothing causes a reduction in the variance of $\overline{|Z(t_k,\omega_l)|}$ and $\overline{|X(t_k,\omega_l)|}$, when compared with the non-smoothed values and the distribution of $(\overline{|Z(t_k,\omega_l)|} - \gamma\overline{|X(t_k,\omega_l)|})$ will be more concentrated around the expected value, which is negative and is given by:

$$E(|\overline{Z(t_k, \omega_l)}| - \gamma|\overline{X(t_k, \omega_l)}|) = (1-\gamma)\sigma\sqrt{\frac{\pi}{2}}.$$

Close-form expressions for the sum (or difference) of independent Rayleigh random variables are not available for ≥3. However, simulation results for the attenuation in dB for various smoothing factors L and oversubtraction factors $\gamma_n$ are presented in the table below where the first column corresponds to no smoothing. In the table, the rows indicate different oversubtraction factors (with values given in the first column) and the columns indicate different averaging areas (with the number of tiles averaged over being presented in the first row):

| | 1 | 2 | 3 | 4 | 5 | 9 | 25 |
|---|---|---|---|---|---|---|---|
| 1.0 | 6.7 | 9.7 | 11.5 | 12.7 | 13.7 | 16.3 | 20.7 |
| 1.2 | 7.8 | 11.5 | 13.9 | 15.7 | 17.1 | 21.3 | 30.4 |
| 1.4 | 8.8 | 13.3 | 16.3 | 18.6 | 20.6 | 26.6 | 42.0 |
| 1.6 | 9.7 | 14.9 | 18.6 | 21.5 | 24.0 | 32.1 | 54.6 |
| 1.8 | 10.6 | 16.5 | 20.7 | 24.3 | 27.2 | 37.6 | 68.0 |
| 2.0 | 11.4 | 17.9 | 22.8 | 26.9 | 30.5 | 42.8 | 82.9 |
| 4.0 | 17.0 | 28.6 | 24.7 | 46.9 | 55.8 | 47.8 | >100.0 |

As can be seen, very high attenuations are achieved.

For speech, the effect of filtering/smoothing is very different than for noise.

First, it is assumed that there is no speech information in $|X(t_k,\omega_l)|$ and thus $\bar{d}$ will not contain "negative" speech contributions. Furthermore, the speech components in neighboring time frequency tiles in the $(t_k,\omega_l)$ plane will not be independent. As a result smoothing will have less effect on the speech energy in $\bar{d}$. Thus, as the filtering results in substantially reduced variance for noise but affects the speech component much less, the overall effect of smoothing is an increase in SNR. This may be used to determine the gain values and/or to designate the time frequency tiles as described previously.

As an example, in many embodiments, the difference measure may be determined as:

$$d(t_k, \omega_l) = f_1\left(\sum_{\substack{n_2=l-K_2 \\ n_1=k-K_1}}^{\substack{l+K_4 \\ k+K_3}} f_a(|X(t_{n_1}, \omega_{n_2})|)\right) - f_2\left(\sum_{\substack{n_4=l-K_6 \\ n_3=k-K_5}}^{\substack{l+K_8 \\ k+K_7}} f_b(|X(t_{n_3}, \omega_{n_4})|)\right)$$

where $f_a$ and $f_b$ are monotonic functions and $K_1$ to $K_8$ are integer values defining an averaging neighborhood for the time frequency tile. Typically, the values $K_1$ to K8, or at least the total number of time frequency tile values being summed in each summation, may be identical. However, in example where the number of values are different for the two summations, the corresponding functions $f_a(x)$ and $f_b(x)$ may include a compensation for the differing number of values.

The functions $f_a(x)$ and $f_b(x)$ may in some embodiments including a weighting of the value in the summation, i.e. they may be dependent on summation index. Equivalently:

$$d(t_k, \omega_l) = f_1\left(\sum_{\substack{n_2=l-K_2 \\ n_1=k-K_1}}^{\substack{l+K_4 \\ k+K_3}} w_{n_1,n_2} \cdot f_a(|X(t_{n_1}, \omega_{n_2})|)\right) - f_2\left(\sum_{\substack{n_4=l-K_6 \\ n_3=k-K_5}}^{\substack{l+K_8 \\ k+K_7}} w_{n_3,n_4} \cdot f_b(|X(t_{n_{43}}, \omega_{n_{43}})|)\right)$$

Thus, in the example, the time frequency tile values of both the first and second frequency domain signals are averaged/filtered over a neighborhood of the current tile.

Specific examples of the function include the exemplary functions previously provided. In many embodiments, $f_1(x)$ or $f_2(x)$ may further be dependent on a noise coherence estimate which is indicative of an average difference between noise levels of the first microphone signal and the second microphone signal. One or both of the functions $f_1(x)$ or $f_2(x)$ may specifically include a scaling by a scale factor which reflects an estimated average noise level difference between the first and second microphone signal. One or both of the functions $f_1(x)$ or $f_2(x)$ may specifically be dependent on the previously mentioned coherence term $C(t_k,\omega_l)$.

As previously set out, the difference measure will be calculated as a difference between a first value generated as a monotonic function of the magnitude of the time frequency tile value for the first microphone signal and a monotonic function of the magnitude of time frequency tile for the second microphone signal, i.e. as:

$$d(t_k,\omega_l)=f_1(|Z(t_k,\omega_l)|)-f_2(|X(t_k,\omega_l)|)$$

where $f_1(x)$ and $f_2(x)$ are monotonic (and typically monotonically increasing) functions of x. In many embodiments, the functions $f_1(x)$ and $f_2(x)$ may simply be a scaling of the magnitude values.

A particular advantage of such an approach is that a difference measure based on a magnitude based subtraction may take on both positive and negative values when only noise is present. This is particularly suitable for averaging/smoothing/filtering where variations around e.g. a zero mean will tend to cancel each other. However, when speech is present, this will predominantly only be in the first microphone signal, i.e. it will predominantly be present in $|Z(t_k, \omega_l)|$. Accordingly, a smoothing or filtering over e.g. neighboring time frequency tiles will tend to reduce the noise contribution in the difference measure but not the speech component. Thus, a particularly advantageous synergistic effect can be achieved by the combination of the averaging and the difference magnitude based difference measure.

Figure 5:
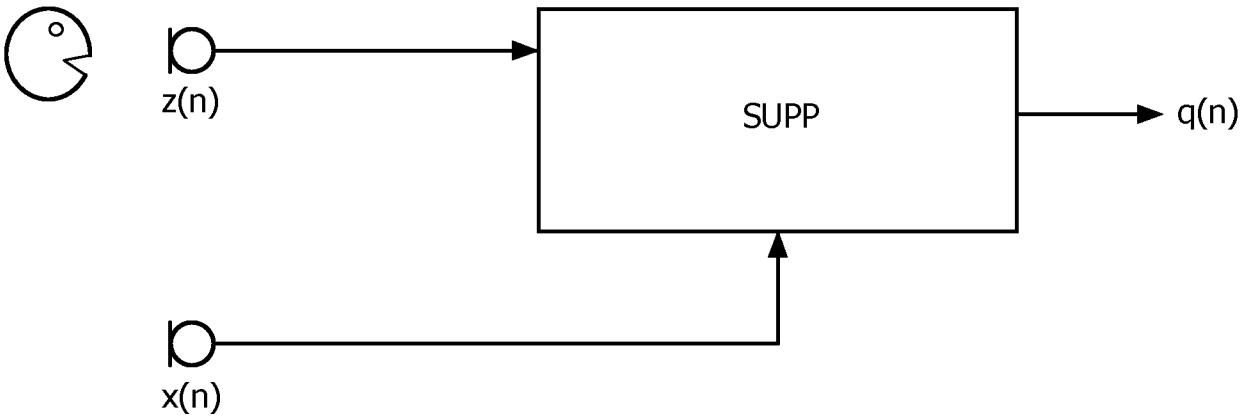
FIG. 5 is an illustration of an example of a noise suppressor configuration in accordance with some embodiments of the invention.

The previous description has focused on a scenario wherein it is assumed that only one of the microphones capture speech whereas the other microphone captures only diffuse noise without any speech component (e.g. corresponding to a situation with a speaker relatively close to one microphone and (almost) no pick-up at the reference microphone as exemplified by FIG. 5).

Thus, in the example, it is assumed that there is almost no speech in the reference microphone signal x(n) and that noise components in z(n) and x(n) are coming from a diffuse sound field. The distance between the microphones is relatively large such that the coherence between the noise components in the microphones is approximately zero.

However, in practice, microphones are often placed much closer together and consequently two effects may become more significant, namely that both microphones may begin to capture an element of the desired speech, and that the coherence between the microphone signals at low frequencies cannot be neglected.

Figure 10:
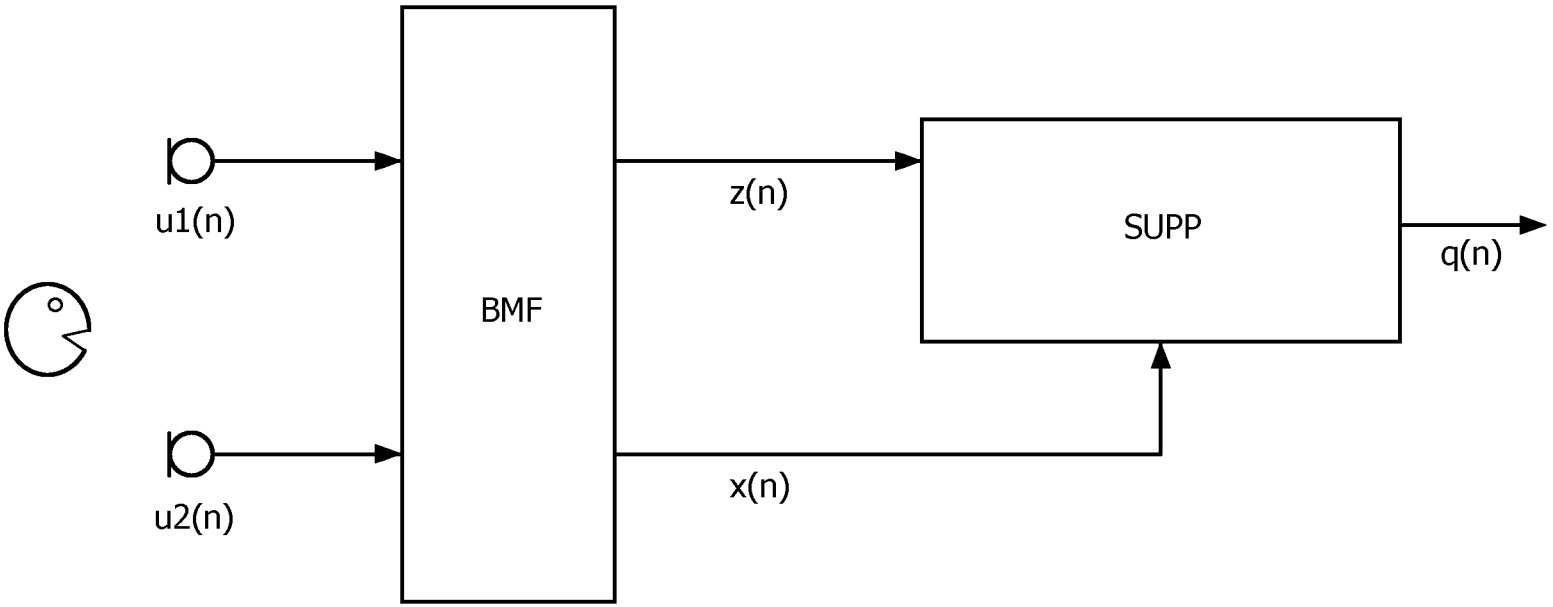
FIG. 10 is an illustration of an example of a noise suppressor configuration in accordance with some embodiments of the invention.

In some embodiments, the noise suppressor may further comprise an audio beamformer which is arranged to generate the first microphone signal and the second microphone signal from signals from a microphone array. An example of this is illustrated in FIG. 10.

The microphone array may in some embodiments comprise only two microphones but will typically comprise a higher number. The beamformer, depicted as a BMF unit, may generate a plurality of different beams directed in different directions, and the different beams may each generate one of the first and second microphone signals.

The beamformer may specifically be an adaptive beamformer in which one beam can be directed towards the speech source using a suitable adaptation algorithm. At the same time, the other beam can be adapted to generate a notch (or specifically a null) in the direction of the speech source.

For example, U.S. Pat. No. 7,146,012 and U.S. Pat. No. 7,602,926 discloses examples of adaptive beamformers that focus on the speech but also provides a reference signal that contains (almost) no speech. Such an approach may be used to generate the first microphone signal as the primary output of the beamformer and the second first microphone signal as the secondary output of the beam former.

This may address the issue of the presence of speech in more than one microphone of the system. Noise components will be available in both beamformer signals and will still be Gaussian distributed for diffuse noise. The coherence function between the noise components in z(n) and x(n) will still be dependent on sinc(kd) as previously described, i.e. at higher frequencies the coherence will be approximately zero and the noise suppressor of FIG. 4 can be used effectively.

Due to the smaller distances between the microphones sinc(kd) will not be zero for the lower frequencies and as a consequence the coherence between z(n) and x(n) will not be zero.

In some embodiments, the noise suppressor may further comprise an adaptive canceller for cancelling a signal component of the first microphone signal correlated with the second microphone signal from the first microphone signal.

Figure 11:
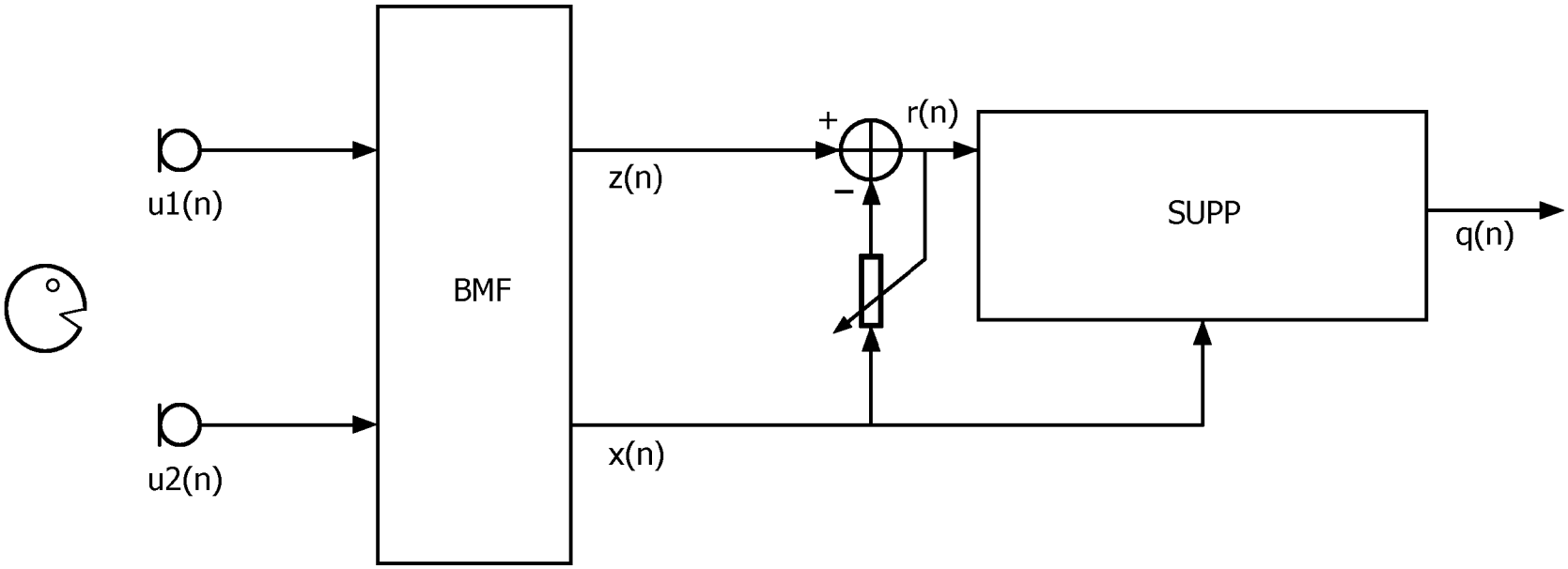
FIG. 11 is an illustration of an example of a noise suppressor configuration in accordance with some embodiments of the invention.

An example of a noise suppressor with both the suppressor of FIG. 4, the beamformer of FIG. 10, and an adaptive canceller is illustrated in FIG. 11.

In the example, the adaptive canceller implements an extra adaptive noise cancellation algorithm that removes the noise in z(n) which is correlated with the noise in x(n). For such an approach, (by definition) the coherence between x(n) and the residual signal r(n) will be zero.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A noise suppressor for suppressing noise in a first microphone signal, the noise suppressor comprising:

a first transformer for generating a first frequency domain signal from a frequency transform of a first microphone signal, the first frequency domain signal being represented by time frequency tile values;

a second transformer for generating a second frequency domain signal from a frequency transform of a second microphone signal, the second frequency domain signal being represented by time frequency tile values;

a gain unit for determining time frequency tile gains as a non-negative monotonic function of a difference measure being indicative of a difference between a first monotonic function of a magnitude time frequency tile value of the first frequency domain signal and a second monotonic function of a magnitude time frequency tile value of the second frequency domain signal; and a scaler for generating an output frequency domain signal by scaling time frequency tile values of the first frequency domain signal by the time frequency tile gains;

the noise suppressor further comprising:

a designator for designating time frequency tiles of the first frequency domain signal as speech tiles or noise tiles; and the gain unit is arranged to determine the time frequency tile gains in response to the designation of the time frequency tiles of the first frequency domain signal as speech tiles or noise tiles such that a lower gain value for a time frequency tile gain of a time frequency tile is determined when the time frequency tile is designated as a noise tile than when the time frequency tile is designated as a speech tile.

2. The noise suppressor of claim 1 wherein the gain unit is arranged to determine a gain value for a time frequency tile gain of a time frequency tile as a function of the difference measure for the time frequency tile.

3. The noise suppressor of claim 2 wherein at least one of the first monotonic function and the second monotonic function is dependent on whether the time frequency tile is designated as a speech tile or as a noise tile.

4. The noise suppressor of claim 3 wherein the second monotonic function comprises a scaling of the magnitude time frequency tile value of the second frequency domain signal for the time frequency tile with a scale value dependent on whether the time frequency tile is designated as a speech time frequency tile or a noise time frequency tile.

5. The noise suppressor of claim 3 wherein the gain unit is arranged to generate a noise coherence estimate indicative of a correlation between an amplitude of the second microphone signal and an amplitude of a noise component of the first microphone signal and at least one of the first monotonic function and the second monotonic function is dependent on the noise coherence estimate.

6. The noise suppressor of claim 5 wherein the first monotonic function and the second monotonic function are such that an expected value of the difference measure is negative if an amplitude relationship between the first microphone signal and the second microphone signal corresponds to the noise coherence estimate and the time frequency tile is designated as a noise tile.

7. The noise suppressor of claim 6 wherein the gain unit is arranged to vary at least one of the first monotonic function and the second monotonic function such that the expected value of the difference measure for the amplitude relationship between the first microphone signal and the second microphone signal corresponding to the noise coherence estimate is different for a time frequency tile designated as a noise tile than for a time frequency tile designated as a speech tile.

8. The noise suppressor of claim 1 wherein the designator is arranged to designate time frequency tiles of the first frequency domain signal as speech tiles or noise tiles in response to difference values generated in response to the difference measure for a noise tile to the magnitude time frequency tile values of the first frequency domain signal and magnitude time frequency tile values of the second frequency domain signal.

9. The noise suppressor of claim 8 wherein the designator is arranged to filter difference values over a plurality of time frequency tiles, the filtering including time frequency tiles differing in both time and frequency.

10. The noise suppressor of claim 1 wherein the gain unit is arranged to filter gain values over a plurality of time frequency tiles, the filtering including time frequency tiles differing in both time and frequency.

11. The noise suppressor of claim 1 wherein the gain unit is arranged to filter at least one of the magnitude time frequency tile values of the first frequency domain signal and the magnitude time frequency tile values of the second frequency domain signal; the filtering including time frequency tiles differing in both time and frequency.

12. The noise suppressor of claim 1 further comprising an audio beamformer arranged to generate the first microphone signal and the second microphone signal from signals from a microphone array.

13. The noise suppressor of claim 1 further comprising an adaptive canceller for cancelling a signal component of the first microphone signal correlated with the second microphone signal from the first microphone signal.

14. A method of suppressing noise in a first microphone signal, the method comprising:

generating a first frequency domain signal from a frequency transform of a first microphone signal, the first frequency domain signal being represented by time frequency tile values;

generating a second frequency domain signal from a frequency transform of a second microphone signal, the second frequency domain signal being represented by time frequency tile values;

determining time frequency tile gains as a non-negative monotonic function of a difference measure being indicative of a difference between a first monotonic function of a magnitude time frequency tile value of the first frequency domain signal and a second monotonic function of a magnitude time frequency tile value of the second frequency domain signal; and generating an output frequency domain signal by scaling time frequency tile values of the first frequency domain signal by the time frequency tile gains;

the method further comprising:

designating time frequency tiles of the first frequency domain signal as speech tiles or noise tiles; and wherein the time frequency tile gains are determined in response to the designation of the time frequency tiles of the first frequency domain signal as speech tiles or noise tiles such that a lower gain value for a time frequency tile gain of a time frequency tile is determined when the time frequency tile is designated as a noise tile than when the time frequency tile is designated as a speech tile.

15. A computer program product comprising computer program code means adapted to perform all the steps of claim 14 when said program is run on a computer.

* * * * *